US012128272B2

(12) United States Patent
McGaffin et al.

(10) Patent No.: US 12,128,272 B2
(45) Date of Patent: Oct. 29, 2024

(54) EXERCISE MACHINE

(71) Applicant: PILATES EQUIPMENT LTD, Belfast (GB)

(72) Inventors: Neal McGaffin, Newry (GB); Yvette McGaffin, Newry (GB); Austin Owens, Leominster (GB); Elio Giordano, Presteigne (GB); Daniel Owens, New Radnor (GB); Dan Perrett, Monmouth (GB)

(73) Assignee: PILATES EQUIPMENT LTD, Belfast (GB)

( * ) Notice: Subject to any disclaimer, the term of this patent is extended or adjusted under 35 U.S.C. 154(b) by 259 days.

(21) Appl. No.: 17/799,346

(22) PCT Filed: Feb. 1, 2021

(86) PCT No.: PCT/EP2021/052282
§ 371 (c)(1),
(2) Date: Aug. 12, 2022

(87) PCT Pub. No.: WO2021/160453
PCT Pub. Date: Aug. 19, 2021

(65) Prior Publication Data

US 2023/0079786 A1 Mar. 16, 2023

(30) Foreign Application Priority Data

Feb. 13, 2020 (GB) ..... 2002002

(51) Int. Cl.
*A63B 22/00* (2006.01)
*A63B 22/20* (2006.01)

(52) U.S. Cl.
CPC ..... *A63B 22/0089* (2013.01); *A63B 22/0005* (2015.10); *A63B 22/001* (2013.01); (Continued)

(58) Field of Classification Search
CPC ..... A63B 22/0089; A63B 22/0005; A63B 22/001; A63B 22/203; A63B 2022/0033; (Continued)

(56) References Cited

U.S. PATENT DOCUMENTS 6,045,491 A * 4/2000 McNergney ..... A63B 22/0087 482/121
7,563,211 B1 * 7/2009 Wu ..... A63B 21/0552 482/130

(Continued)

OTHER PUBLICATIONS

International Search Report and Written Opinion for International Application No. PCT/EP2021/052282; mailing date of May 4, 2021.

(Continued)

*Primary Examiner* — Garrett K Atkinson
(74) *Attorney, Agent, or Firm* — Fresh IP PLC; Clifford D. Hyra; Aubrey Y. Chen

(57) ABSTRACT

A pilates reformer machine has a frame with a longitudinal central extruded spine (2) extending between a first support member (4*a*, 4*b*) and a second support member (6*a*, 6*b*), a carriage (8) supporting a platform (9) moveable along the spine, at least one retention spring housed within the spine and attached to the carriage, the at least one retention spring being selectively attachable to the frame by buttons (12), the carriage being provided with sides that wrap around sides of the spine and engage with an underneath of the spine, the carriage further including a plurality of wheels receivable within tracks formed within the central spine. A leg exerciser (30) and foot bar (20) may be included in the machine.

17 Claims, 21 Drawing Sheets

(52) U.S. Cl.
CPC .... *A63B 22/203* (2013.01); *A63B 2022/0033* (2013.01); *A63B 2022/0035* (2013.01)

(58) Field of Classification Search
CPC ..... A63B 2022/0035; A63B 21/00065; A63B 21/0552; A63B 22/0087; A63B 24/0087; A63B 2022/0079; A63B 22/0076; A63B 71/0054; A63B 21/151; A63B 21/153; A63B 21/154; A63B 2220/13; A63B 2220/17; A63B 2220/89; A63B 2225/09; A63B 2225/30; A63B 21/0428; A63B 21/023; A63B 21/00; A63B 21/0557
See application file for complete search history.

(56) References Cited

U.S. PATENT DOCUMENTS 7,803,095 B1 * 9/2010 LaGree ..... A63B 22/0089 482/121
8,641,585 B2 * 2/2014 LaGree ..... A63B 22/203 482/92
9,586,089 B2 * 3/2017 Lagree ..... A63B 22/203
9,868,011 B2 * 1/2018 Lagree ..... A63B 71/06
10,201,724 B2 * 2/2019 Lagree ..... A63B 21/00069
10,702,730 B2 * 7/2020 Lagree ..... A63B 21/00069
2004/0053752 A1 * 3/2004 Yang ..... A63B 22/203 482/70
2007/0219053 A1 * 9/2007 Barufka ..... A63B 21/02 482/4
2012/0295771 A1 * 11/2012 LaGree ..... A63B 22/203 482/94
2014/0213423 A1 * 7/2014 Masterson ..... A63B 21/152 482/131
2015/0360113 A1 * 12/2015 Lagree ..... A63B 71/0054 482/121
2018/0178053 A1 * 6/2018 Lagree ..... A63B 21/4027

OTHER PUBLICATIONS

UKIPO Combined Search and Examination Report for Application No. GB2002002.0, date of report Aug. 4, 2020.
UKIPO Search Report Under Section 17 for Application No. GB2002002.0, date of search Aug. 3, 2020.

* cited by examiner

FIG. 6A
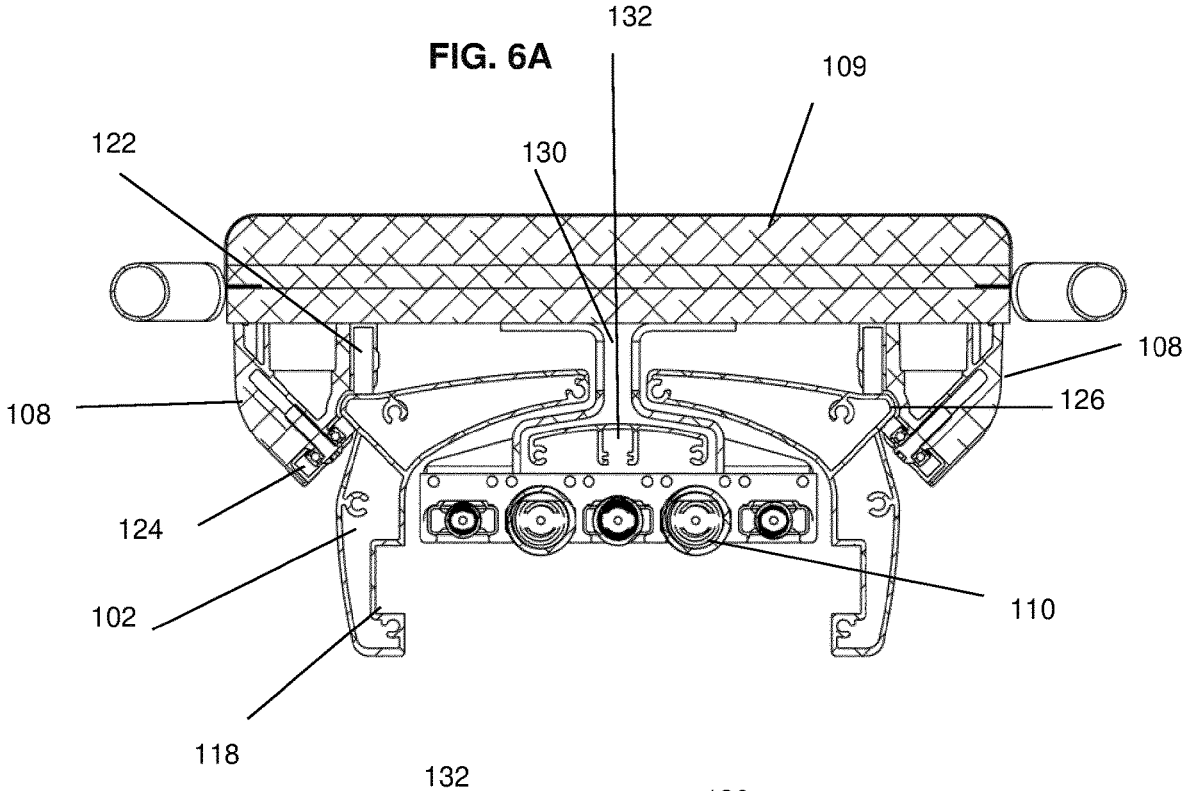
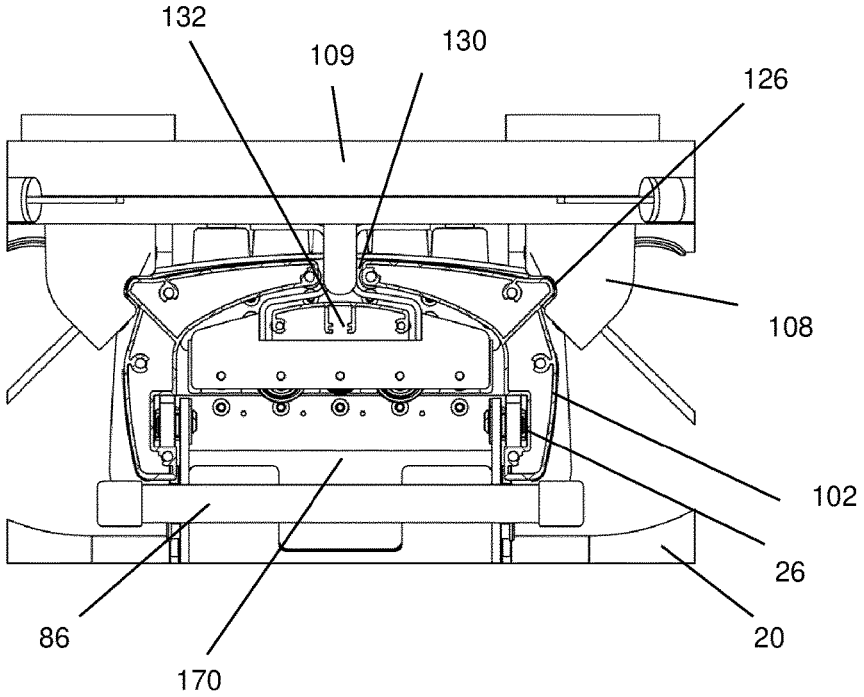
FIG. 6B

EXERCISE MACHINE

FIELD OF THE INVENTION

The present invention relates to an improved exercise machine, particularly not exclusively a pilates reformer machine.

BACKGROUND

The Pilates reformer machine was invented by Pilates founder Joseph Pilate and typically consists of a rectangular bed-like frame supporting a pair of parallel rails extending in the longitudinal direction of the apparatus, the rails supporting a slidable carriage which is able to roll back and forth on wheels within the frame. The carriage is attached to one end of the reformer by a set of swappable springs which may be removably attached between the carriage and an end of the frame to create variable resistance on the carriage which must be overcome by a user of the machine in order for the carriage to slide along the rails. Most reformer exercises involve pushing or pulling the carriage or holding the carriage steady during an exercise as it is pulled on by the springs thereby enabling a wide range of exercises to be carried out to promote strength, flexibility, and balance.

There is a vast number of different types of Pilates reformer machines currently on the market which are variations on the above theme and these types of machine are becoming increasingly popular for providing a full body workout and conditioning. However, the existing machines do have their limitations. The bed-like frame often results in the machine being heavy and cumbersome making storage and transportation problematic, but the presence of the frame prevents the user contacting the floor in a beneficial way. The machines can be difficult to clean, particularly beneath the frame and it can prove difficult to change the resistance provided by the set of springs. The exposed retention springs and the need to hook and unhook the springs from the frame can also lead to injury. Given the cost and size of the machine, it is desirable to be able to do as many types of exercises as possible on the machine, thereby removing the need for additional pieces of exercise equipment. It is also desirable to be able to monitor the user's performance while using the exercise machine.

It is the aim of the present invention to provide an improved exercise machine that overcomes, or at least alleviates, the abovementioned problems.

SUMMARY OF THE INVENTION

According to a first aspect of the present invention there is provided an exercise machine comprising a frame having a longitudinal central spine extending between a first support member and a second support member, a carriage supporting a platform moveable along the spine, at least one retention spring or band housed within the spine and attached to the carriage, the at least one retention spring or band being selectively attachable to the frame, the carriage being provided with sides that wrap around sides of the spine and engage with an underneath of the spine, the carriage and/or platform further including a plurality of wheels receivable within tracks formed on or within the central spine.

Preferably, the spine has an upper part and dependent side parts and the sides of the carriage extend around the side parts and engage with an underneath of the spine, the at least one retention spring or band and the plurality of wheels being located within the spine.

It is to be appreciated that the retention spring may comprise a coiled spring or may be in the form of a retention band, such as an elastic band, for providing the required resistance to movement of the carriage. Generally, multiple springs or bands are provided for providing variable resistance.

More preferably, the spine comprises an extrusion, preferably an aluminium extrusion, which enables the cross-section of the spine to be provided with multiple recesses for receiving parts of the carriage. Preferably, the profile of the extrusion is shaped to create multiple recesses required for receipt of parts of the carriage, associated wheels and the retention springs/bands. The main body of the extruded spine may be provided with an internal lattice to impart strength and rigidity.

In a preferred embodiment, the extruded spine has a continuous top surface, preferably being slightly curved, and two opposing convex sides that terminate in opposing carriage wheel tracks.

Additionally, the carriage may comprise an extruded part for mating with the spine extrusion. Preferably, the carriage extrusion comprises two support flanges, having outer sides extending downwardly and inwardly therefrom, a base part extending substantially perpendicularly inwardly from each outer side and inner sides extending upwardly from each base part. The support flanges serve to support a platform that is secured to the top of the carriage. Preferably, each inner side is extruded to terminate with at least one retention spring housing, for example in the form of a tube, preferably having an oval cross-section. The extruded part of the carriage may also be provided with an internal lattice to impart strength. Carriage wheels are preferably attached to an inner face of each inner side of the extrusion.

In this manner, the extruded carriage may fit snugly around the extruded spine with the carriage wheels being received in the opposing carriage wheel tracks and the at least one retention spring housing being located within the extruded spine.

A retention spring or band is housed within the tube and may be selectively secured to an end of the spine by buttons, in cooperation with plungers, that are able to extend through the spine, for example through vertical channels provided through the extruded spine to engage with an end of the retention spring. However, the invention is not limited to vertically orientated buttons and plungers.

Preferably, the exercise machine also comprises a foot bar that extends around both the central spine and platform/carriage and is selectively movable along the length of the spine. The foot bar runs on a plurality of wheels but can be locked at angles between its general plane and the spine axis and at positions along the length of the spine.

In a preferred embodiment, the spine is also provided with recesses forming tracks for receiving opposing foot bar wheels, preferably these recesses are provided within an interior boundary of the spine.

In one embodiment the foot bar is a n-shaped cylindrical bar that is dimensioned to fit around the spine and the platform/carriage. Opposing inwardly extending connecting bars may be provided at each end of the n-shaped bar for receipt within a socket that rotatably engages with a foot bar location mechanism. The foot bar location mechanism comprises a bracket having a plurality of wheels or travel bearings which may be received within the foot bar wheel tracks of the spine to enable the foot bar to travel along the length of the spine. Preferably, the foot bar is able to be locked in position at a desired point along the central spine by locking means and/or the angle of the foot bar may be adjusted between a series of angles by means of an angular position latch.

Optionally, the bracket of the foot bar location means may comprise substantially parallel plates, an outer face of each plate having a longitudinal travel latch that mates with holes or recesses provided at longitudinal intervals along at least part of the length of the spine to lock the foot bar in a longitudinal position, and wherein a notch is provided on each socket of the foot bar, rotation of which effects movement of the travel latch.

Optionally, a second latch may be provided to communicate less well with the series of recesses, the second latch being sprung loaded to hold the foot bar less firmly with respect to the longitudinal positions.

Preferably, an inner face of each plate has an angular position latch that mates with a series of recesses provided at circumferentially disposed intervals, the recesses preferably being provided on an inner latch member attached to the inner face of each plate and to each end of the foot bar.

More preferably, a foot pedal is connected to each angular position latch of the plates to simultaneously effect movement of each latch. For example, the foot pedal may extend transversely across the spine for operation from either side of the spine, the foot pedal having a connecting member that connects the pedal to each latch. Again in an optional embodiment, a second latch may be provided to communicate less well with the series of recesses, the second latch being sprung loaded to hold the foot bar less firmly in incremental angular positions.

In an alternative embodiment of the invention, the carriage may comprise at least one folded bracket that attaches to the underside of the platform, the folded bracket being provided with sides that wrap around sides of the spine and engage with an underneath of the spine, the platform further including a plurality of wheels receivable within tracks formed on or within the central spine. Preferably, a plurality of castors is provided on the underside of the platform for engaging with tracks in the spine. In this embodiment, the at least one retention spring or band may be housed within the folded bracket.

The exercise machine according to the present invention may include other component parts to increase its versatility. For example, the frame may include one or more support boards and/or removable shoulder rests.

Preferably the machine includes at least one cord extending between the carriage to an end of the machine and back to the carriage via a pulley mechanism for enabling a user to move the carriage by pulling on the at least one cord. More preferably, one end of the cord is wound around a bobbin provided in a recoil unit that is attached to the carriage and the other end of the cord terminates in a handle or cuff, the cord passing around a first pulley provided at an end of the machine.

In one embodiment of the present invention, the machine includes a leg exerciser attached to one end of the frame. Preferably the leg exerciser comprises a cross bar pivotally connected to the frame by at least one pivot arm, more preferably the pivot arm is sprung loaded. Preferably, the at least one cord may be extended around the cross bar to impart resistance thereto.

More preferably, the machine includes a second pulley spaced apart from the first pulley about which the cord can be wound around before being extended around the cross bar. Preferably each end of the cross bar is provided with a bobbin or reel for receiving the handle or cuff of the cord.

Optionally, the first and second pulley may be provided with cover. The cord may also be fully or partially retractable when not in use.

A second aspect of the present invention provides an exercise machine comprising a frame having at least one longitudinal rail extending between a first support member and a second support member, a carriage supporting a platform moveable along the at least one rail, at least one retention spring or band attached to the carriage, the at least one retention spring or band being selectively attachable to the frame and at least one cord extendable from the carriage/platform of the frame and terminating in a handle, the machine further comprising a cross bar pivotally connected to an end of the frame by at least one pivot arm and wherein the at least one cord is selectively positionable between a first position and a second position, wherein in the first position the cord extends around a first pulley back towards the carriage such that applying tension on the cord moves the carriage and in the second position the cord extends around a second pulley spaced apart from the first pulley and the handle of the cord receives a part of the cross bar such that applying tension on the cord applies tension to the cross bar. In this manner, generally downward movement of the cross bar is resisted by the cord when it is in the second position.

It is to be appreciated that two pulley systems each comprising a first and second pulley is preferably provided each side of an end of the frame.

Thus, the cross bar provides a leg exerciser that is operated by the cord. The cross bar may comprise a T-shaped member that is pivotally attached to the frame or the cross bar may be attached to two arms that are each pivotally attached to the frame. Preferably, the at least one arm pivotally attached to the frame is sprung loaded.

Preferably each end of the cross bar is provided with a bobbin or reel for receiving the handle or cuff of the cord.

The first and second support members provided at each end of the machine according to the first or the second aspect of the present invention preferably form two legs each end of the frame which stabilise the machine. Accordingly, the support members should have a width that is greater than the width of the spine. Preferably the support members have a width that is substantially the same as the width of the platform.

It is to be appreciated that either aspect of the present invention may be provided with a button mechanism for operation of the retention springs provided beneath the carriage. Preferably the position of the buttons/plungers is sensed, such as with an electrical switch at the end of its travel, thereby enabling monitoring of which springs are engaged. Furthermore, this mechanism may be under the control of electrical actuators (motorized plungers or solenoids) rather than mechanical buttons, also enabling monitoring of which springs are engaged. An appropriate sensor (not shown) may also be provided along the central spine, such as Hall effect sensors or a time of flight laser, to enable monitoring of the position of the platform along the central spine.

In a preferred embodiment, the button and plunger mechanism for operation of the retention springs or bands includes means to prevent operation of the mechanism when the carriage is away from the end of the spine (i.e. when the carriage is moved away from the buttons during exercising). Preferably, a sprung loaded locking pin is provided in a transverse channel at or towards the base of each button and plunger. Upward movement of the button and plunger to disengage the retention spring creates a space beneath the button and plunger into which the locking pin is able to slide, thereby preventing downward movement of the button and plunger while the locking pin is in this position. Preferably, the carriage is provided with an opposing transverse plunger that is able to push the locking pin back out of the space beneath the button and plunger when the carriage returns to the end of the spine, thereby allowing the button and plunger to be pushed downwardly to re-engage with the retention spring or band.

Preferably, the opposing transverse plunger is provided by an eyelet on the end of each spring or band, wherein the leading edge of the eyelet is able to move the locking pin and the hole of the eyelet lies in the path of the button and plunger to allow their downward movement to re-engage the spring or band.

A third aspect of the present invention provides an exercise machine comprising a frame having at least one longitudinal rail extending between a first support member and a second support member, a carriage supporting a platform moveable along the at least one rail, at least one retention spring or band attached to the carriage, the at least one retention spring or band being selectively attachable to the frame by engagement with a button and plunger mechanism, wherein a sprung loaded locking pin is provided in a channel transverse to a direction of movement of the button and plunger whereby disengagement of the retention spring or band by movement of the button and plunger allows movement of the locking pin into a space previously occupied by the plunger.

It is to be appreciated that the direction of movement of the button and plunger may be vertical or horizontal depending upon the configuration of the retention springs or bands. Preferably, the direction of movement is vertical wherein the sprung loaded locking pin is provided in a transverse channel at or towards the base of a vertical channel through which the plunger moves whereby upon disengagement of the button/plunger from the retention spring the locking pin is able to slide into the vertical channel to prevent downward movement of the button.

Preferably, the machine includes multiple retention springs/bands that are operated independently by separate button/plunger mechanisms, each having an associated sprung loaded locking pin.

More preferably, the carriage is provided with an opposing transverse plunger for retraction of the locking pin from the channel beneath the button/plunger upon return of the carriage to the end of the rail. Optionally, the plunger that engages the spring/band is provided with a curved section for engagement with a detent in a wall of the plunger channel, thereby biasing the plunger towards an up or down position.

Positional sensing of the carriage along the platform and the resistance on the springs, together with speed of travel will enable an interface to be provided detailing performance, such as work rate and energy consumption.

According to a fourth aspect of the present invention, there is provided an exercise machine comprising a frame having at least one longitudinal rail extending between a first support member and a second support member, a carriage supporting a platform moveable along the at least one rail, at least one retention spring or band selectively attachable to the carriage and a foot bar extending around the carriage, platform and the at least one rail, wherein the foot bar includes a foot bar location mechanism comprising a bracket having two substantially parallel plates, each plate having wheels or bearings for running along the at least one rail, an outer face of each plate having a longitudinal travel latch for locking the foot bar in a longitudinal position with respect to the at least one rail and an inner face of each plate having an angular position latch for locking the foot bar at a desired angle selectable between a series of angles with respect to the at least one rail and wherein at least one of the longitudinal or angular position latch is movable by a foot pedal connected to the bracket.

Preferably, the longitudinal travel latch mates with holes or recesses provided at spaced apart intervals along at least part of the length of the at least one rail, such as an extruded spine.

Preferably, the foot bar is connected to each plate of the bracket by a rotatable socket, each socket having a notch whereby rotation of foot bar moves the notch to effect movement of the travel latch.

The angular position latch preferably mates with a series of recesses provided at circumferentially disposed intervals on the inner face of each plate, the recesses preferably being provided on an inner latch member attached to the inner face of each plate and to an end of each foot bar. The foot pedal is preferably connected to each angular position latch of the plates to simultaneously effect movement of each latch.

It is to be appreciated that the different aspects of the invention may be provided separately in different types of exercise machine or, most preferably, in the same machine.

BRIEF DESCRIPTION OF THE DRAWINGS

For a better understanding of the present invention and to show more clearly how it may be carried into effect, reference will now be made by way of example only to the accompanying drawings in which:

FIG. 6A is a cross-sectional view through part of a pilates reformer machine according to another embodiment of the present invention, showing the platform, carriage, spine and retention springs;

FIG. 6B is another cross-sectional view of the pilates reformer machine of FIG. 6A showing the mechanism for operation of the foot bar contained within the central spine;

FIG. 100 is a plan view from below of the platform and carriage sub-assembly of FIG. 10A;

DETAILED DESCRIPTION

The present invention provides a pilates former machine which is sleeker, more compact and lighter than prior art pieces of equipment and optionally includes additional exercise components to enable a complete body workout.

Figure 1:
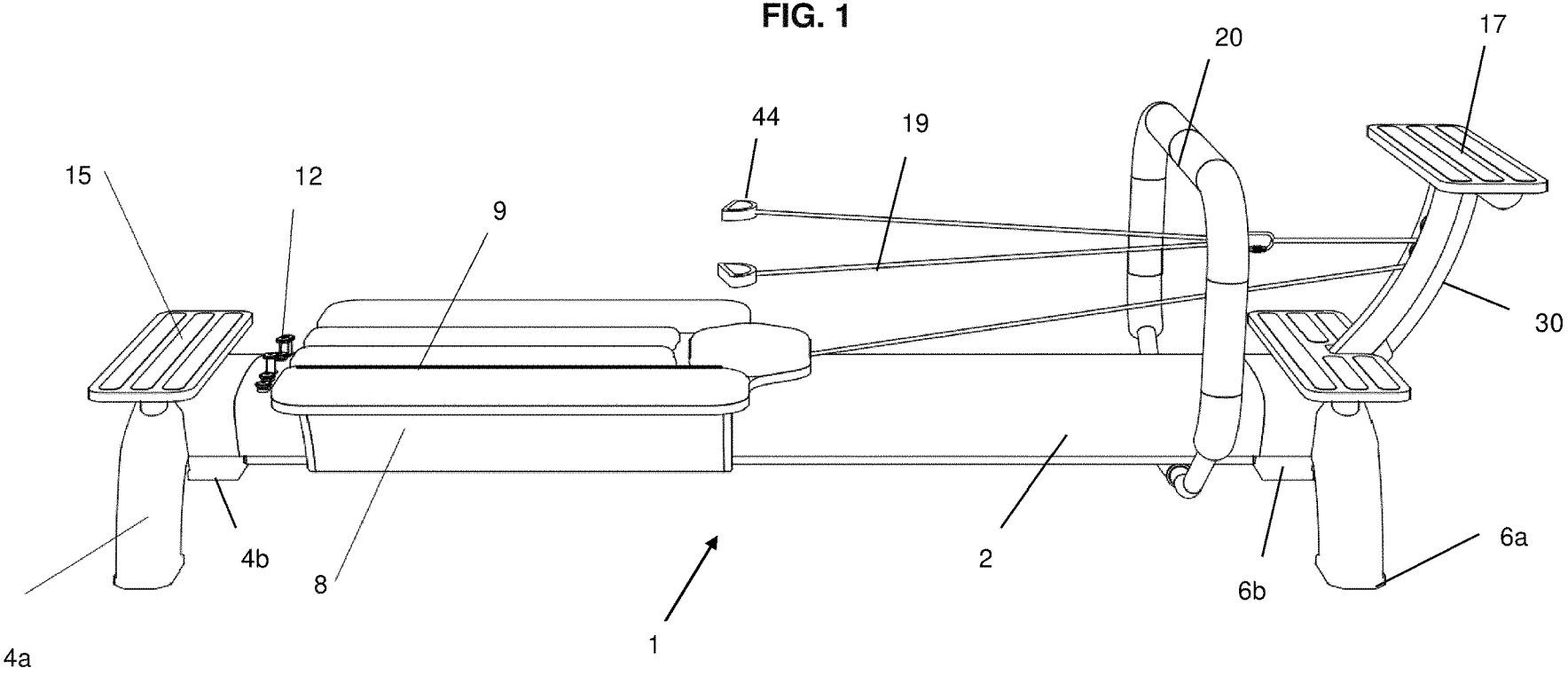
FIG. 1 is a side view of a pilates reformer machine according to one embodiment of the present invention.
Figure 2:
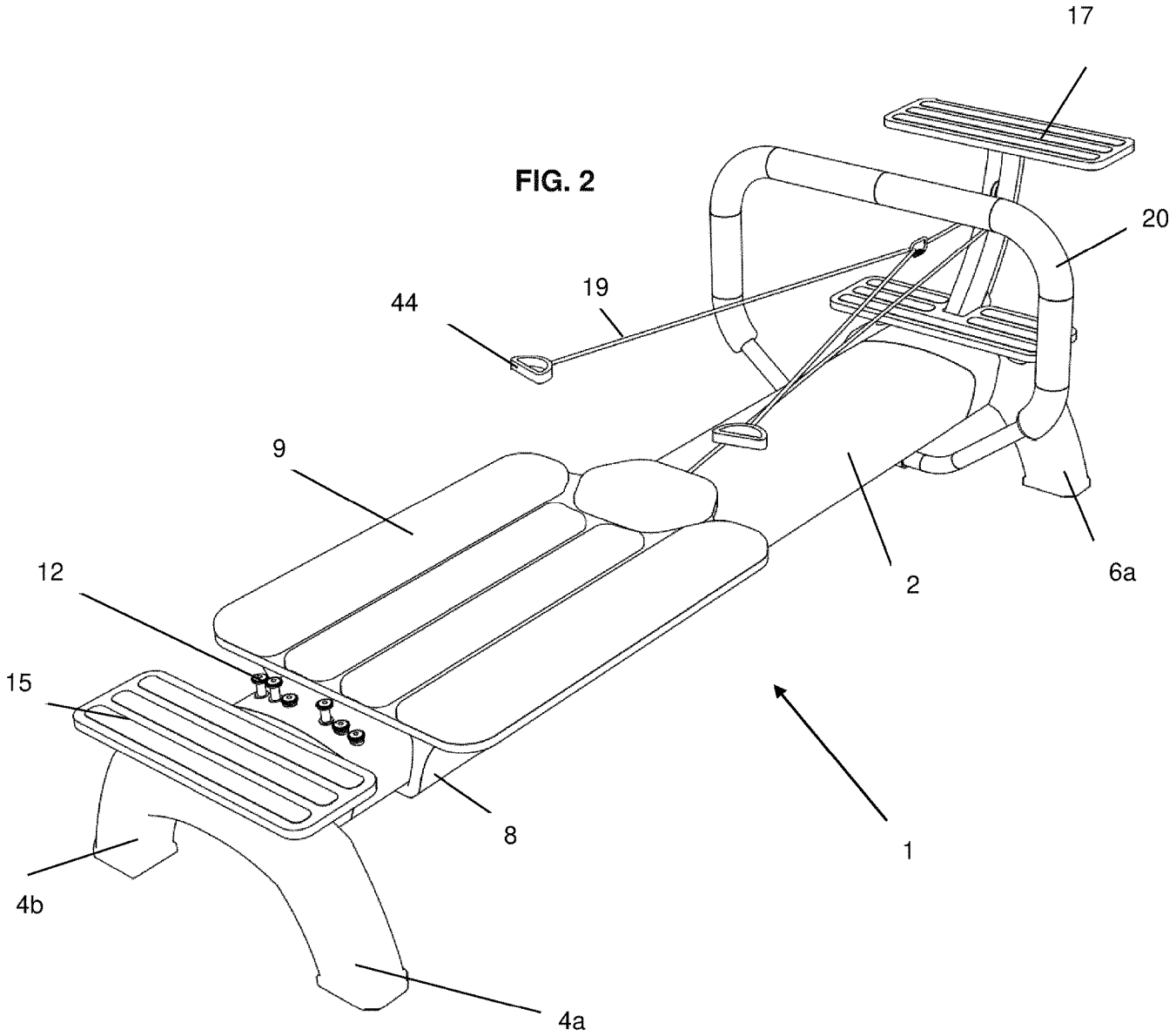
FIG. 2 is a perspective view of the machine shown in FIG. 1.
Figure 3:
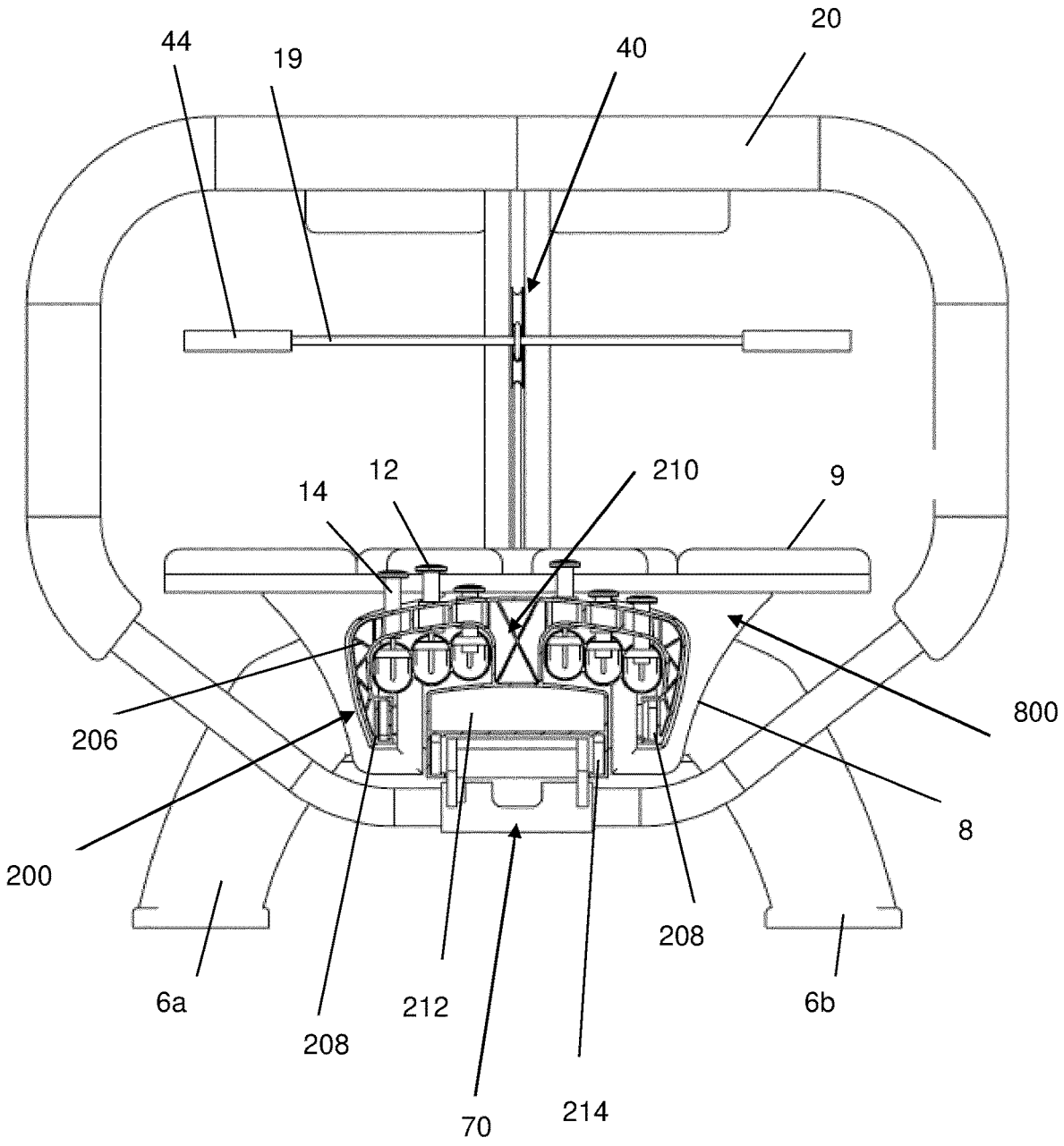
FIG. 3 is a cross-sectional view of the machine of FIG. 1.
Figure 4:
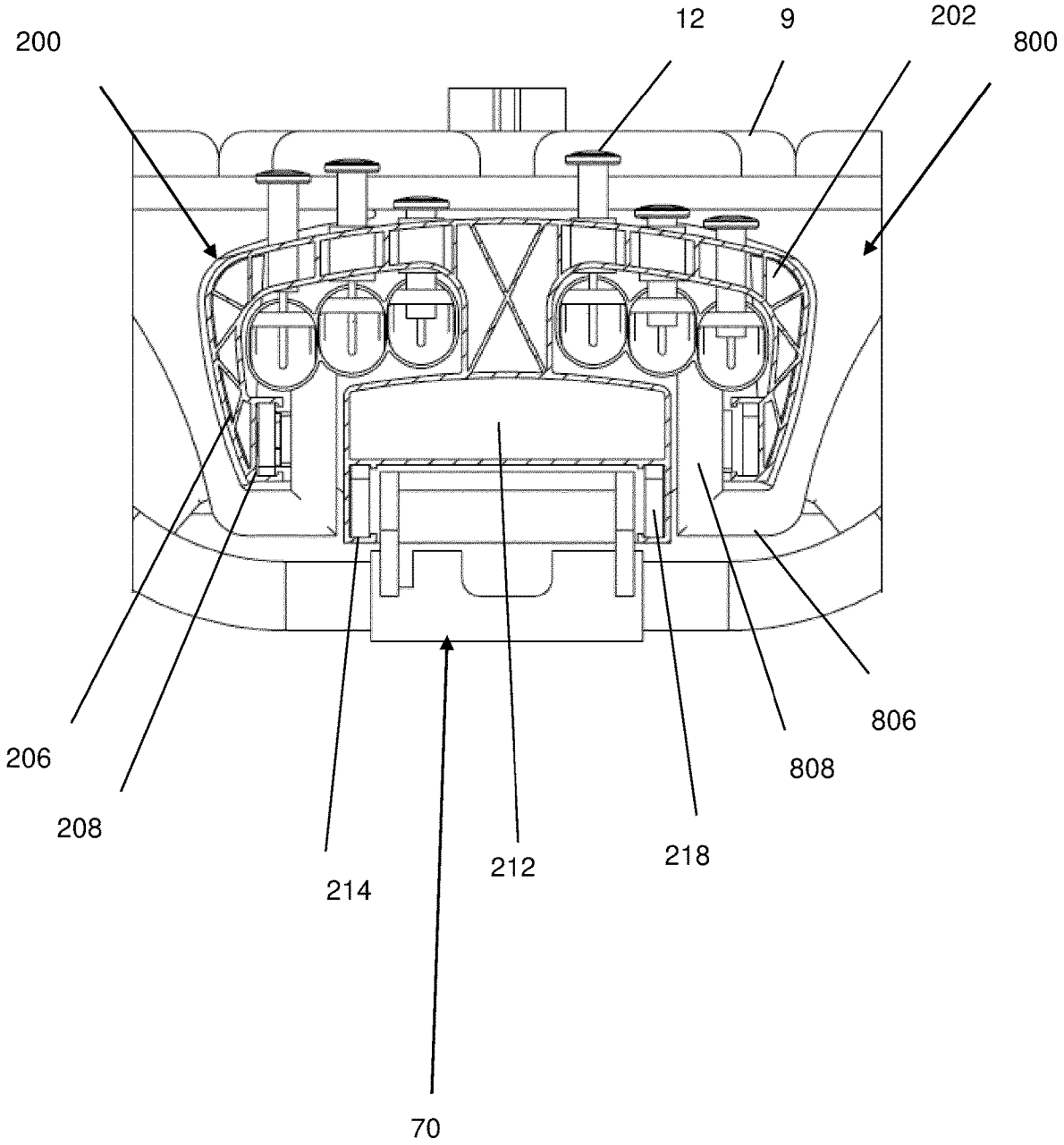
FIG. 4 is an enlarged view of part of the wrap-around carriage, foot bar and extruded spine shown in FIG. 3.

FIGS. 1 and 2 of the accompanying drawings illustrates one embodiment of a pilates reformer machine according to the present invention.

The machine 1 comprises a frame having a central support spine 2 extending between a front support member 4 and a rear support member 6 provided at the ends of the spine. The support members each comprise a n-shaped component to provide two legs 4*a*, 4*b*, 6*a*, 6*b* which extend outwardly beyond the perimeter of the spine to stabilise the machine. A slidable carriage 8 supporting a flat platform 9, which may be padded for comfort, is connected around the spine and is able to run along the length of the spine. Additionally, a series of retention springs 10 (not visible in FIGS. 1 and 2 but described in more detail below) are provided underneath the carriage within the spine and are releasably engageable with an end of the spine by means of a button and plunger mechanism provided at the end of the spine. Each retention spring may be disengaged from the end of the spine by a button 12 that co-operates with a vertical plunger (not visible in FIGS. 1 and 2). The machine also includes a foot bar 20 that connects to the underside of the spine and is selectively slidable along the length of the spine and is dimensioned to be able to surround the carriage 8 and platform 9. The foot bar 20 is also connected to the spine via a foot bar location mechanism 70 that enables the bar to rotate between different angles and be secured at a desired position (see further details in relation to FIGS. 15A to 16D below). Each end of the frame is provided with support boards 15, 17 and exercise cords 19 extend from the platform 9 around a pulley mechanism 40 provided at the end support board 17 and back to the platform 9 where the cord terminates in handles or cuffs 44.

As is evident from FIG. 2 of the accompanying figures, the machine has the majority of the connections between the component parts located within the central spine 2 with the carriage and foot bar being slidable there along. This is achieved by both the carriage 8 and foot bar 20 wrapping around the central spine and being attached thereto underneath the spine. FIGS. 3 to 4, 5A and 5B illustrate this attachment mechanism in further detail. The spine comprises an aluminium extrusion 200 which enables the cross-section of the spine to be provided with multiple recesses for receiving parts of the carriage and foot bar location mechanism. The main body of the extruded spine is provided with an internal prismatic lattice 202 to impart strength and rigidity with the outer profile being shaped to create the multiple recesses required for receipt of the carriage, foot bar location mechanism, associated wheels and the retention springs. As shown most clearly in FIG. 5A, the extrusion 200 has a slightly curved, continuous top surface 204 and two opposing convex sides 206 that terminate in opposing carriage wheel tracks 208. Additionally, a central appendage 210 extends downwardly from the top surface and terminates in a large recess 212 with opposing foot bar mechanism wheel tracks 214. The space between each side 206 and the central appendage 210 and each side and the large recess 212 forms a receptacle for receiving an extruded part 800 forming the carriage 8.

Figure 5A:
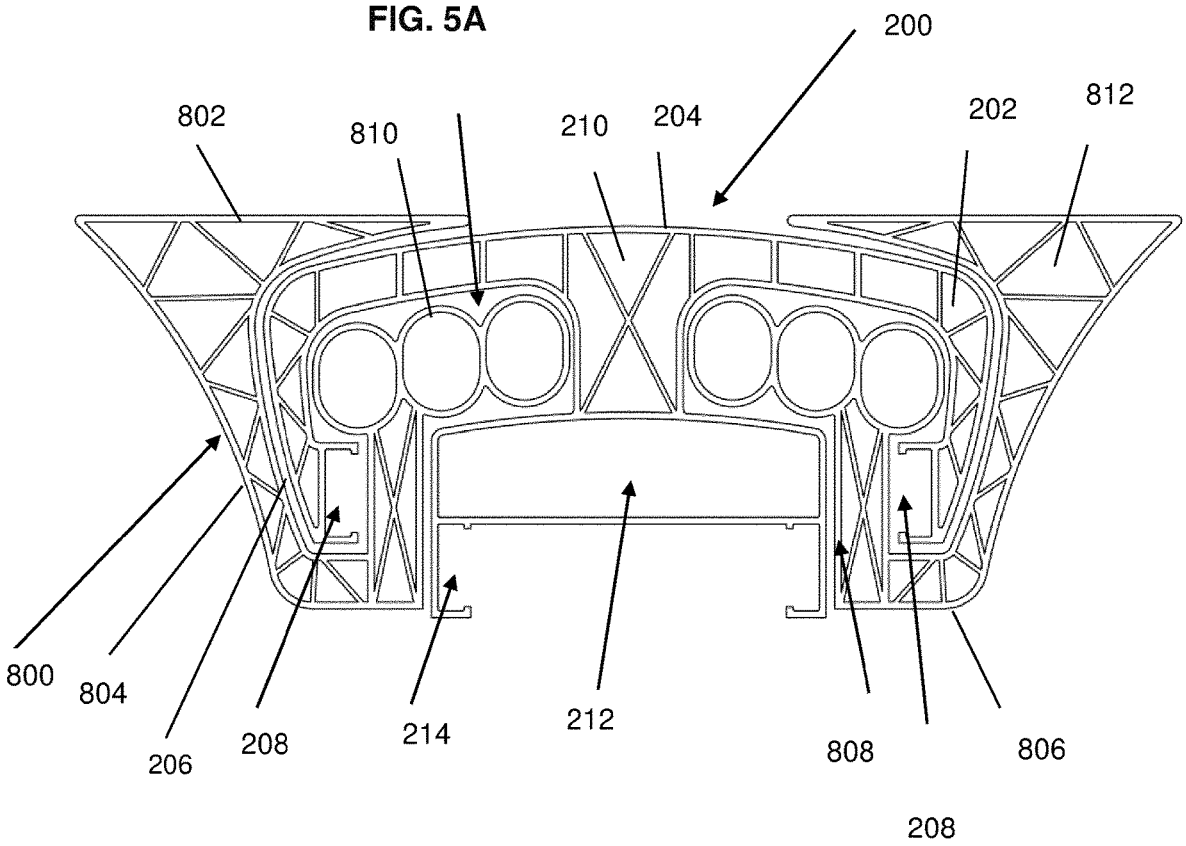
FIG. 5A illustrates the extruded parts of the wrap-around carriage and extruded spine of FIG. 4, shown without the foot bar and wheels.
Figure 5B:
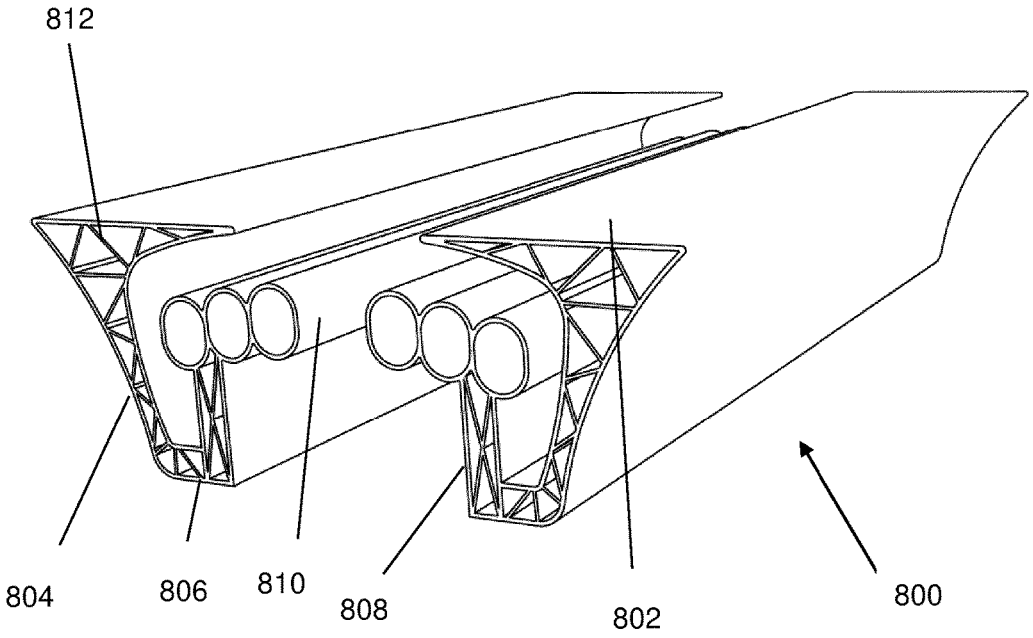
FIG. 5B is a perspective view of the extruded part of the wrap-around carriage shown in FIG. 5A.
Figure 7A:
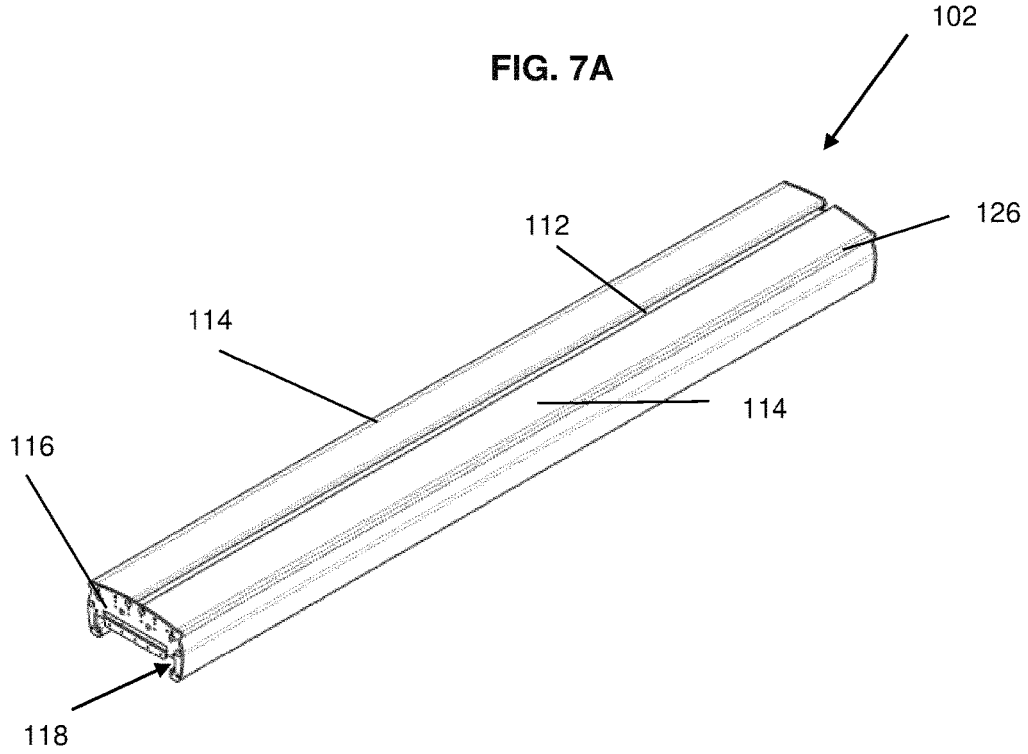
FIGS. 7A and 7B are respectively a perspective view from above and a plan view from below of the spine of the machine of FIGS. 6A and 6B.
Figure 7B:
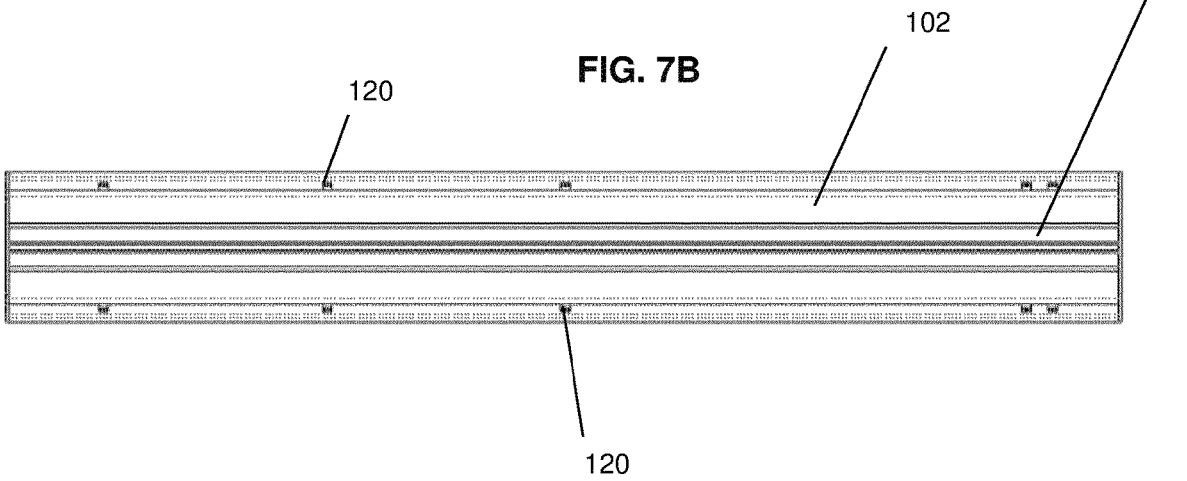

The extruded part 800 of the carriage 8 is shown inserted within the extruded spine in FIG. 5A and shown without the spine in FIG. 5B. The extrusion comprises two opposing large support flanges 802 which serve to support a flat, rectangular platform 9 that is secured to the top of the carriage. Outer sides 804 extend downwardly and inwardly from each flange and the outer sides then extend perpendicularly inwardly thereto and then turn upwardly to form a base part 806 and inner side 808 respectively. Each inner side terminates with three adjacent tubes 810 having an oval cross-section that form spring retention housings. The extruded part of the carriage is also provided with an internal lattice 812 to impart strength.

Referring back to FIGS. 3 and 4, the securement of the carriage 8 and foot bar mechanism 70 of the foot bar 20 to the extruded spine is illustrated. The extruded part 800 of the carriage 8 has a wheel or roller attached to an internal face of each inner side 808 via an axle. The extruded part fits around and within the extruded spine such that each wheel is received within the carriage wheel tracks 208 and the tubes 810 at the end of each inner side are received in each receptacle 218 of the extruded spine. The retention springs 10 are housed within the tubes 810 and are selectively secured to an end of the spine by buttons 12 in cooperation with plungers that are able to extend through vertical channels provided through the extruded spine 2 to the interior of the tubes. Further details of the mechanism provided for selective securement of the retention springs is provided with reference to FIGS. 17A and 17B below. The platform 9 is fixedly secured to the flanges of the carriage and the carriage is able to slide along the spine by movement of the wheels along the tracks 208.

It should be noted that while the illustrated embodiments show the use of retention springs for the provision of variable resistance to movement of the carriage and platform, it is to be appreciated that other means may be employed to provide adjustable resistance, such as elasticated bands. The retention springs or bands should be made of a material that provides the necessary resistance and has the required longevity.

The foot bar 20 is a substantially n-shaped cylindrical bar that is dimensioned to fit around the spine and the carriage/platform. Opposing inwardly extending connecting bars

20*a*, 20*b* extend from each end of the n-shaped bar and attach to a bracket of the foot bar location mechanism 70 for receipt within the extruded spine (further details of which are provided in relation to FIGS. 15A to 16D) below. The bracket is provided with a plurality of wheels 26 or travel bearings which are received within the wheel tracks 214 of the extruded spine to enable the foot bar to travel along the length of the spine. The foot bar is able to be locked in position at a desired point along the central spine by operation of a pedal (not shown in relation to this embodiment but discussed in further detail in relation to the embodiments shown in FIGS. 6B and 15A to 16D) and the angle of the foot bar may be adjusted between a series of angles as illustrated in FIGS. 16A to 16D.

The receipt of parts of the carriage, the carriage wheels and the wheels of the foot bar location mechanism within the extruded spine provide a substantially closed housing for all the moveable parts which increases the safety of the machine to the user as well as greatly enhancing the overall appearance of the machine.

FIGS. 6A to 7B illustrate another embodiment of the present invention. A central spine 102 is provided which engages with the carriage 108 supporting a platform 109, with the retention springs 110 and foot bar location mechanism 170 being provided within the spine. The longitudinal spine 102 is provided with a central longitudinal slot 112 which may be formed within a single-piece spine or, as in the illustrated embodiment, may be provided between two side rails 114 that are fixed in close proximity to each other by end plates 116 provided at each end, as shown in FIG. 7A. The spine is again provided with convex sides walls which have internal recesses 118 forming wheel tracks for receiving wheels 26 attached to the bracket 24 of the foot bar location mechanism 70, and the underside of each side wall 114 has a plurality of spaced apart recesses 120 for receiving a longitudinal travel latch (not shown) of the foot bar location mechanism (features of this mechanism are described in further detail in relation to FIGS. 15A and 15B). In this embodiment, the carriage comprises four separate parts, one part attached to each corner of the platform, with the underside of each part having a wheel assembly having at least one upper wheel 122 and at least one lower wheel 124 that run along an upper and lower rail provided by a shoulder 126 on each upper corner of the spine. Additionally, a central extrusion or folded bracket 130 consisting essentially of a longitudinal I-beam is received within slot 112 to secure the platform to the spring support bracket. A central cover extrusion 132 traverses the full length of the spine 102 and means the user cannot see down through the slot 112. The central extrusion 130 or folded bracket wraps around this cover extrusion. This embodiment removes the need to provide a carriage that extends all around the sides of the spine.

Figure 8:
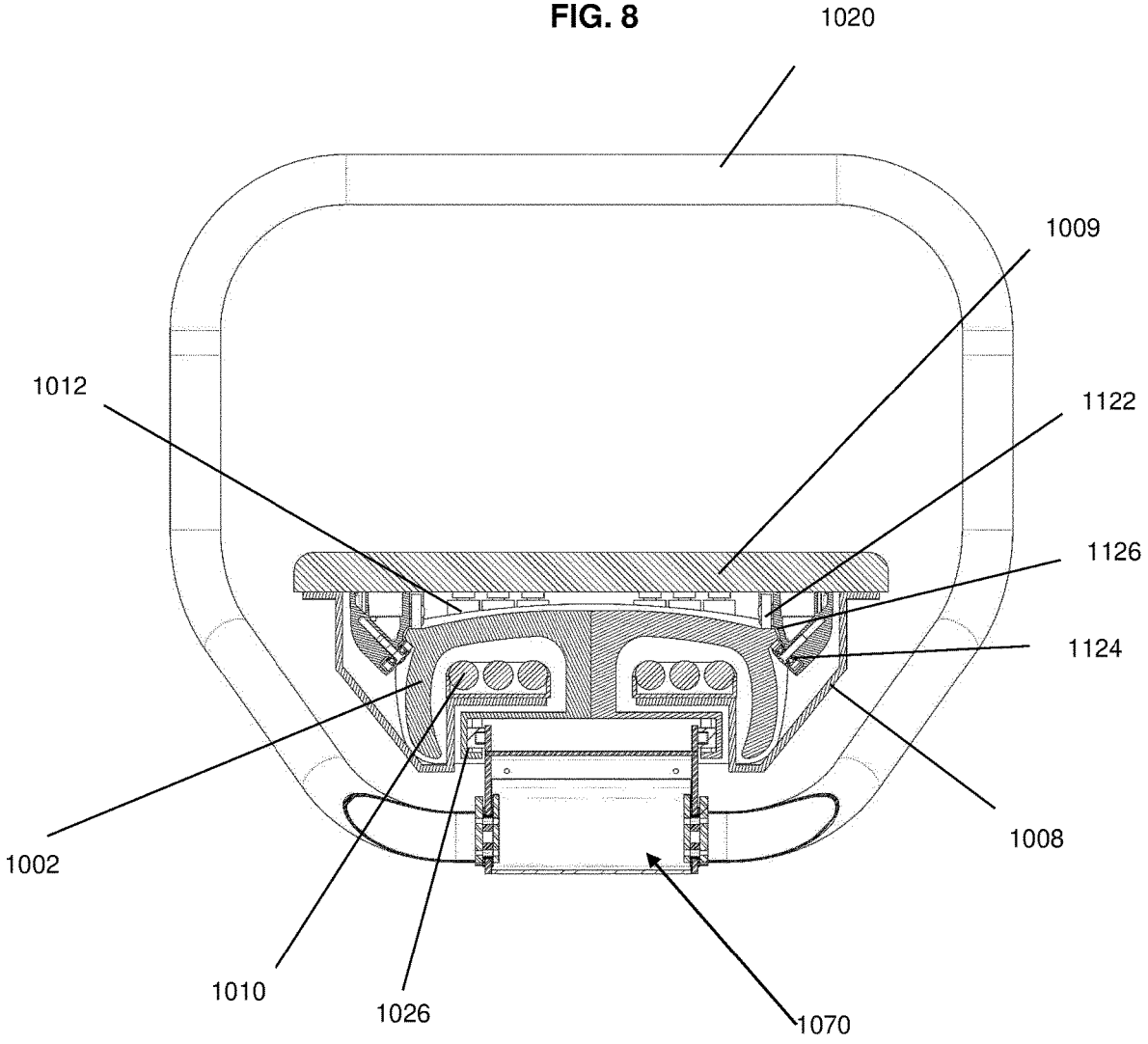
FIG. 8 is a schematic cross-sectional view through part of a pilates reformer machine according to yet another embodiment of the invention.
Figure 9A:
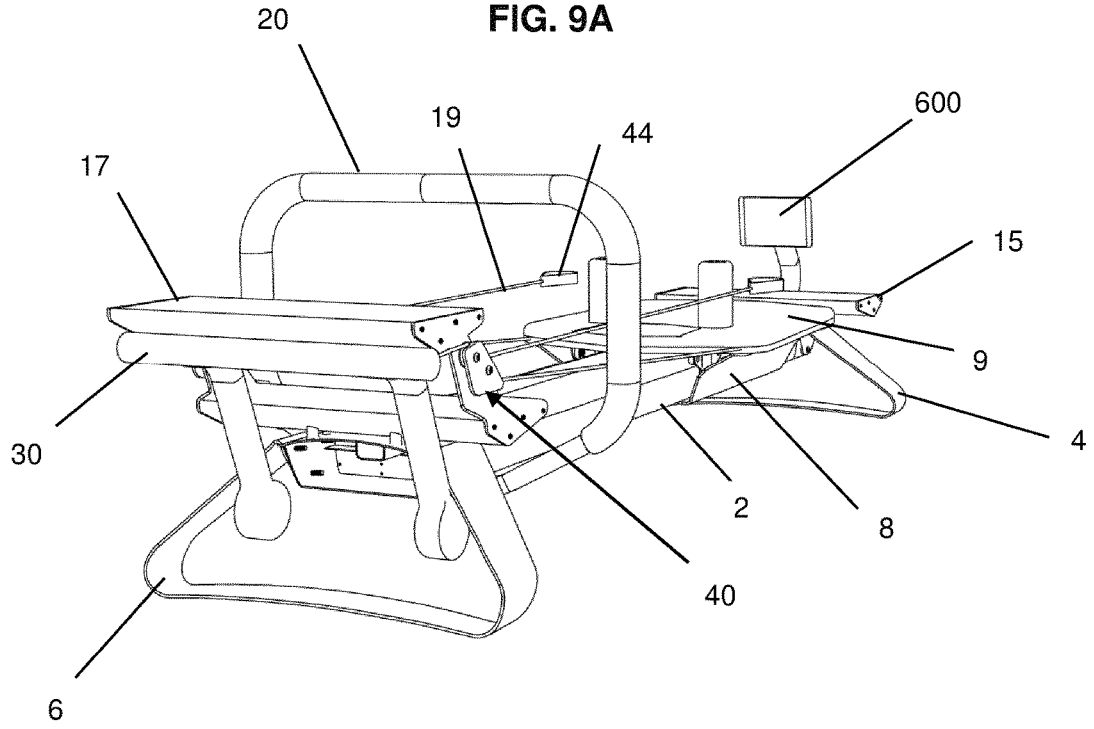
FIG. 9A is a perspective view from the one end of a pilates reformer machine according to another embodiment of the present invention having a folded bracket carriage, and illustrating an integral leg exerciser machine according to an aspect of the invention, shown retracted.
Figure 9B:
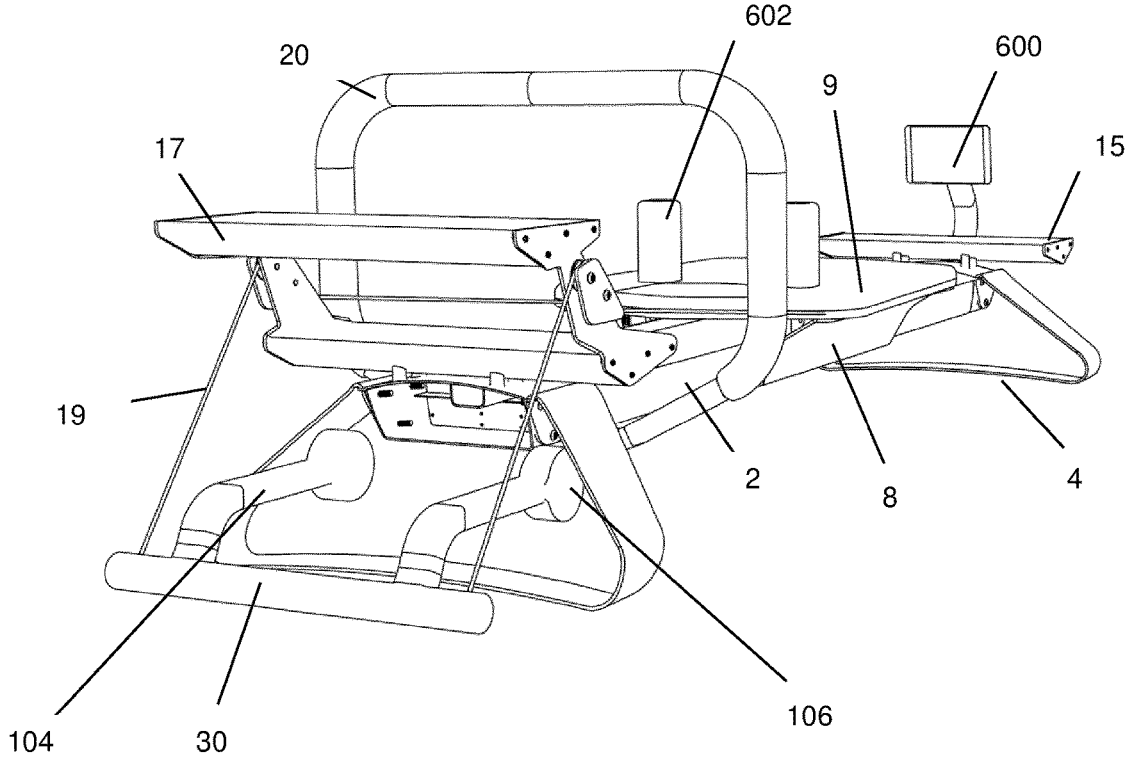
FIG. 9B is a perspective view of the pilates reformer machine of FIG. 9A shown with the integral leg exerciser machine extended.

FIG. 8 illustrates yet a further embodiment of a pilates reformer machine according to the present invention, which again has a carriage 1008 attached to the platform 1009 which wraps around a central continuous spine 1002 encompassing many of the moving parts of the machine. A foot bar 1020 again connects to the underside of the spine and is selectively slidable long the length of the spine and is dimensioned to surround the carriage 1008 and platform 1009. The spine extrusion again has a continuous upper surface and convex side walls and includes a central member that extends downwardly from the upper surface, a lower end of the central member terminating in two opposing transverse members extending laterally from the central member, each transverse member forming wheel-receiving tracks for receiving wheels 1026 of a foot bar location mechanism 1070. The configuration of the spine provides two opposing upper recesses for receiving retention springs or elasticated bands 1010 and a lower recess for receiving the foot bar location mechanism 1070. A folded sheet material 1008 forms the carriage, the ends of the carriage wrapping around the convex side walls of the spine and terminating in the upper recesses of the spine. Wheels 1122, 1124 are provided within the carriage and slide along tracks on the upper corners of the spine provided by shoulder 1126. Buttons 1012 are provided for selective engagement of the retention springs as described in further detail elsewhere herein.

FIGS. 9A to 12F illustrate yet another embodiment of the present invention. A single central spine extrusion 2 is again provided for receiving a slidable carriage 8 supporting a platform 9. A carriage sub-assembly 850 comprises a folded bracket that has sides that wrap around the spine and is retained within recesses of the extrusion. Retention spring housings 400 are also attached to the underside of the platform and a foot bar 20 is again included extending around the spine, carriage and platform. The platform is also provided with removable shoulder rests 602 extending upwardly therefrom and a leg exerciser 30 according to another aspect of the invention is provided at one end of the machine. The other end is also provided with a control screen 600.

FIGS. 10A to 11B illustrate the carriage 8 with platform 9, retention spring housing 400, wheel assemblies 208 and a pulley system for the exercise cord 19. The carriage 8 is able to move axially along the spine extrusion 200 via carriage wheel assembly 208. In this embodiment, the underside of the carriage is provided with four carriage wheel assemblies 208, each assembly having four wheels mounted on a common bracket 208*a* (see FIGS. 11A and 11B). Each assembly has two inner carriage wheels 208*b* and two outer carriage wheels 208*c* inclined at an angle relative to the inner wheels 208*b*. The inner vertical wheels 208*b* run along a horizontal track or rail provided on the spine extrusion and the outer wheels 208*c* run along an inclined lower track or rail on the spine extrusion to provide resistance to lateral and upward movement. However, it is to be appreciated that an alternative number and arrangement of wheels could be provided, albeit it is preferable to provide at least one wheel running along a top of the spine and at least one wheel running along a side of the spine.

Figure 17A:
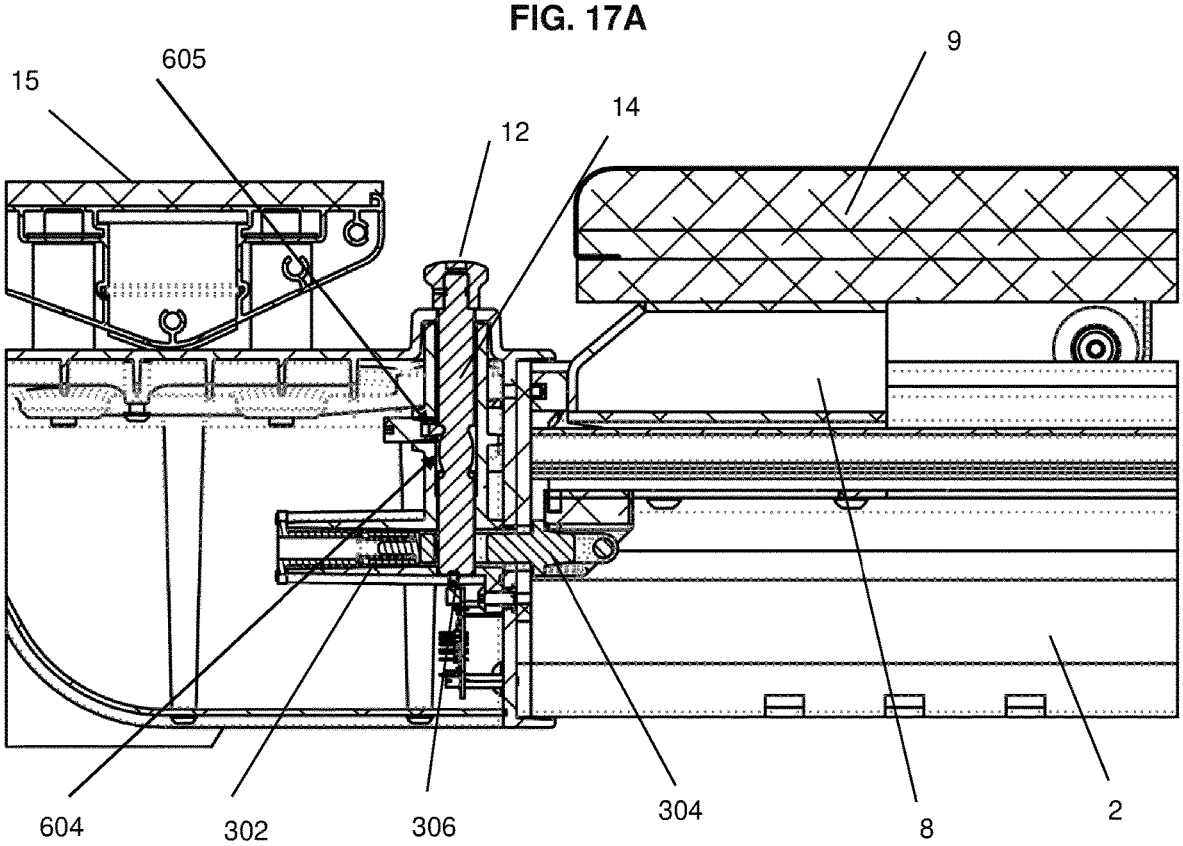
FIGS. 17A and 17B are cross-sections of an end of a pilates reformer machine showing a lockable button and release mechanism according to another aspect of the invention for selection of the retention springs.
Figure 17B:
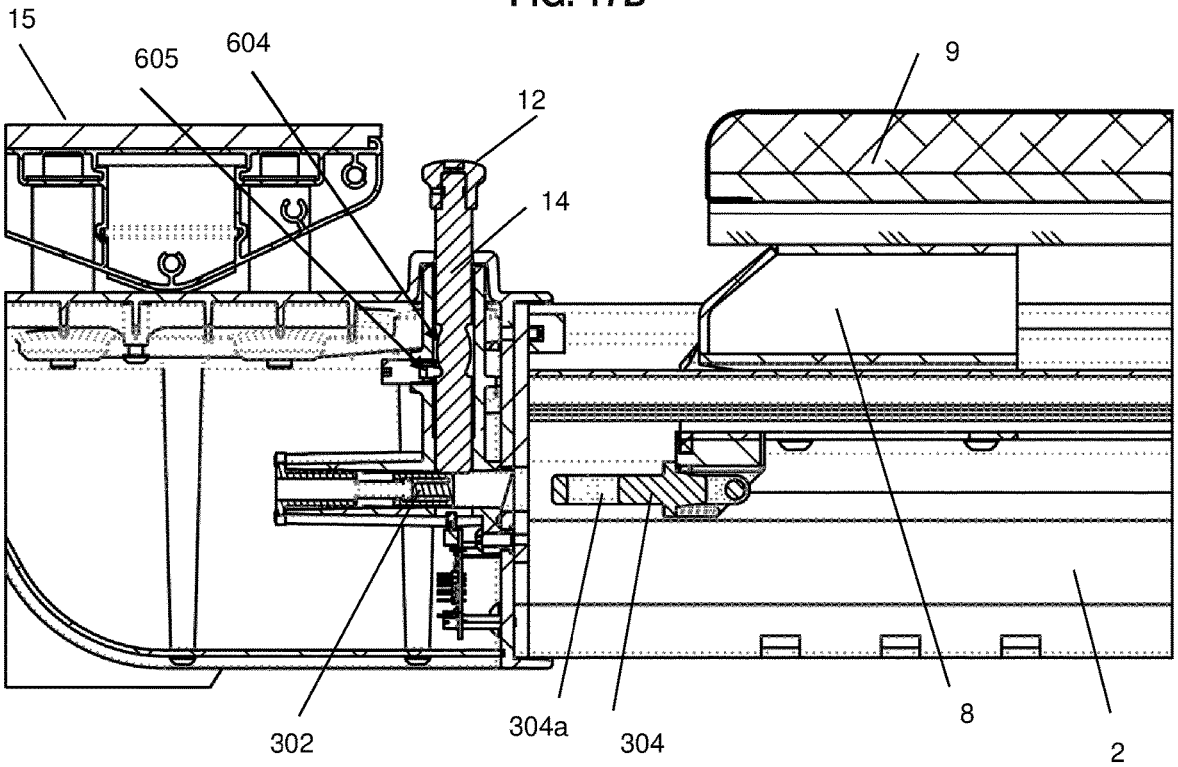

The underside of the platform is also provided with a pair of retention spring housings 400 (see FIGS. 12A to 12F) which each house three coil retention springs 10 and are accommodated within the spine extrusion. The underside of the spring housing is attached to the carriage 850 (1008). One end of the spring 10 is attached to the carriage and the other can be selectively anchored to the end of the machine or kept under slight tension beneath the platform 9. This end of the springs is provided with an eyelet 402 that is selectively secured to the frame by a button 12 and plunger 14 arrangement, for example as illustrated in FIGS. 17A and 17B and discussed in further detail below. Manual engagement of a button 12 acts on a plunger 14 which then pokes through the eyelet attached to the end of the spring. The eyelet sits in a controlled position and moves with the platform or is anchored by the plunger. When an eyelet is not engaged, a spring-loaded barrier 302 ejects beneath the retracted plunger 14 to prevent inappropriate buttons being pressed (discussed in more detail in relation to FIGS. 17A and 1B below). This enables the spring combination to be swapped by manually pressing the buttons 12 to vary the resistance applied to the moving platform. However, it is to be appreciated that this could be under the control of electrical actuators (motorized plungers or solenoids) rather than mechanical buttons. This would have the added benefit of enabling monitoring of which springs were engaged. An appropriate sensor (not shown) may also be provided along the central spine, such as Hall effect sensors or a time of flight laser to enable monitoring of the position of the platform along the central spine.

As with the earlier embodiments, cords 19 extend from the carriage 8 around a pulley mechanism 40 provided at the end support board 17 and back to the carriage 8 where the cord terminates in handles 44. This pulley mechanism may also be used to operate a leg exerciser 30 which is provided at one end of the machine, the leg exerciser comprising a horizontal bar attached perpendicularly to two arms 104 that are rotatable about sprung pivot points 106 (see FIG. 9B) attached to rear support member 6. Further details of this aspect of the invention are provided below in relation to FIGS. 13 to 14F (in which embodiment, only one arm 104 is provided).

Figure 10A:
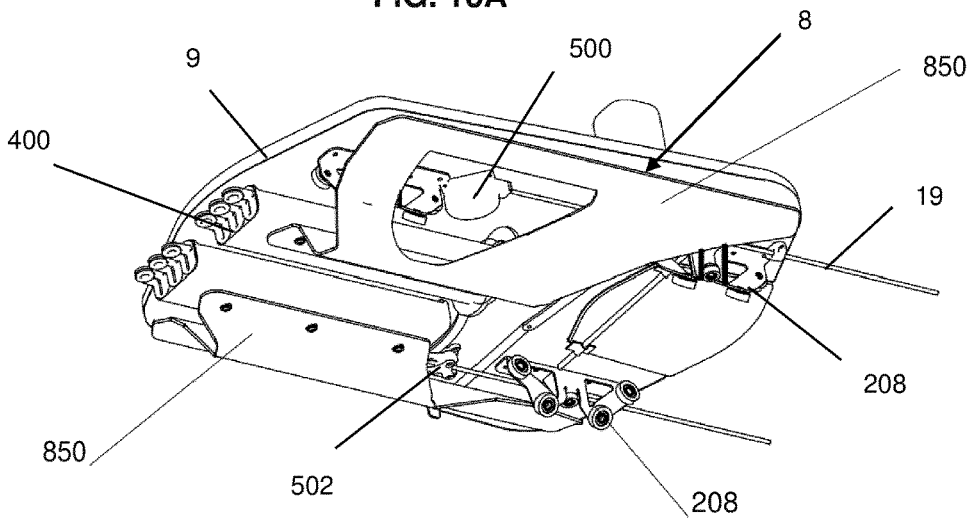
FIG. 10A is a perspective view from below of the platform and carriage sub-assembly for the machine of FIGS. 9A and 9B.
Figure 10B:
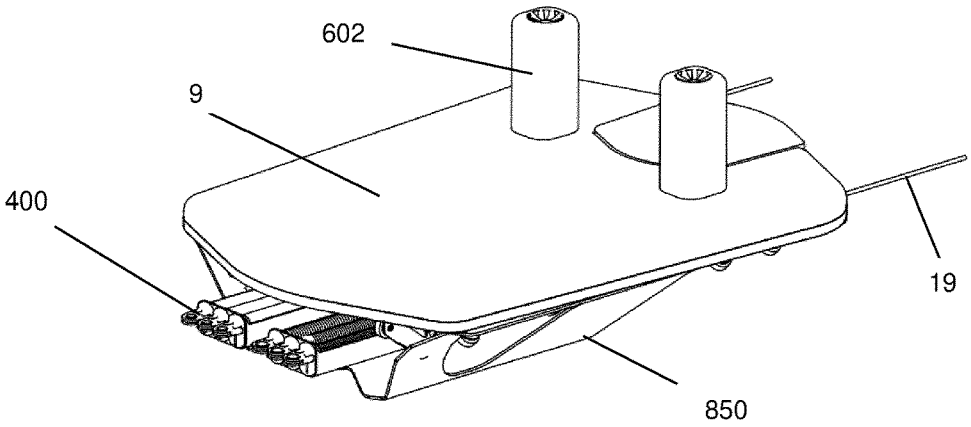
FIG. 10B is a perspective view from above of the platform and carriage sub-assembly of FIG. 10A.
Figure 10C:
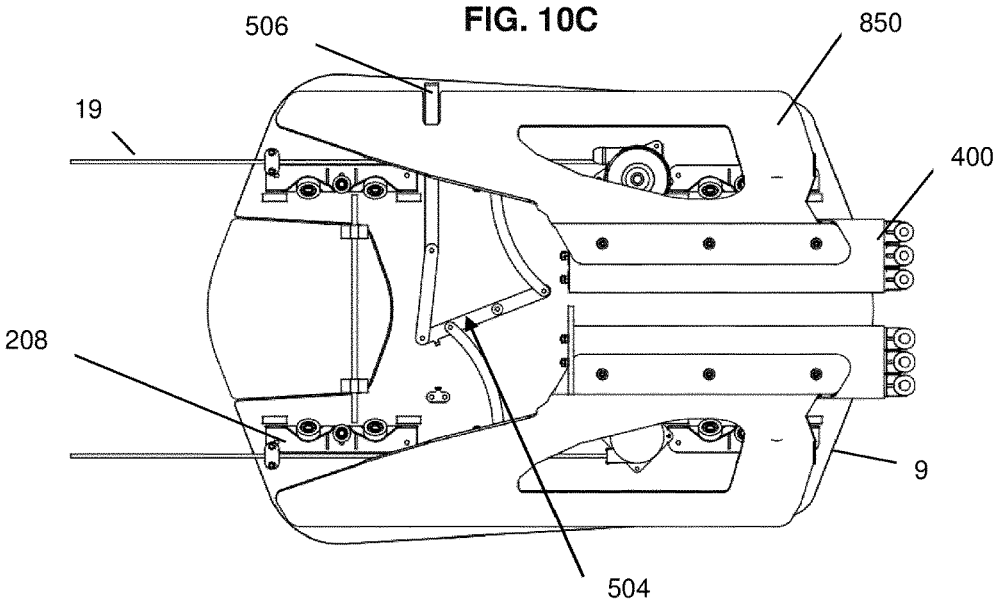
Figure 11A:
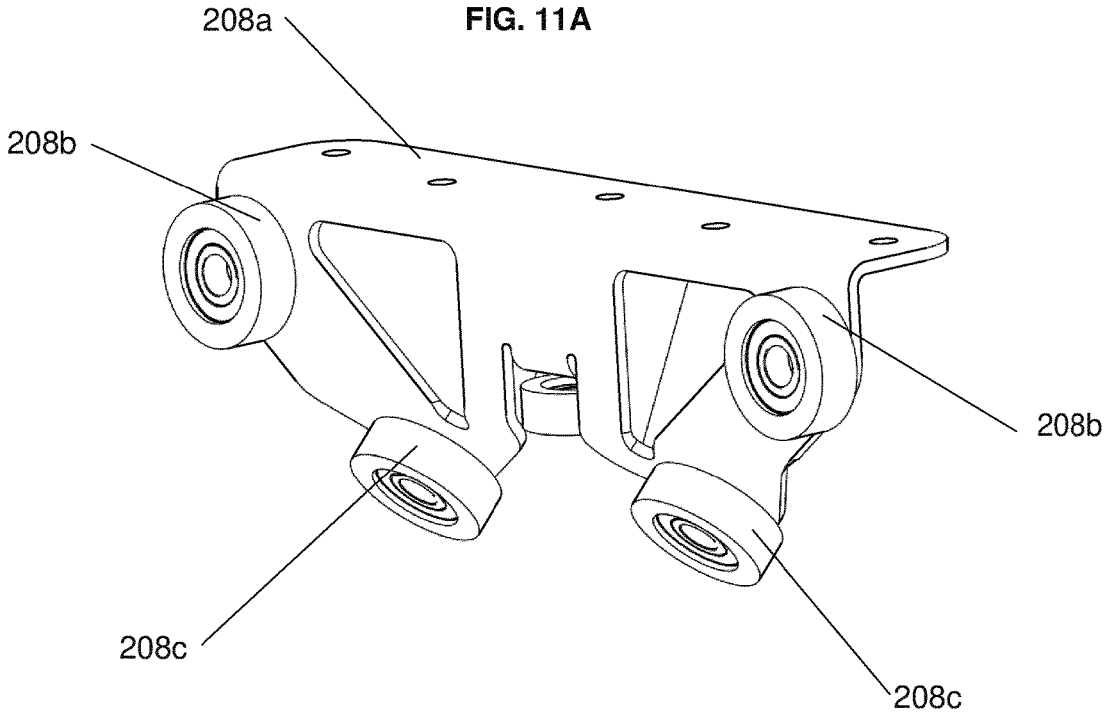
FIGS. 11A and 11B illustrate one example of a carriage wheel assembly for use with a pilates reformer machine of the present invention.
Figure 11B:
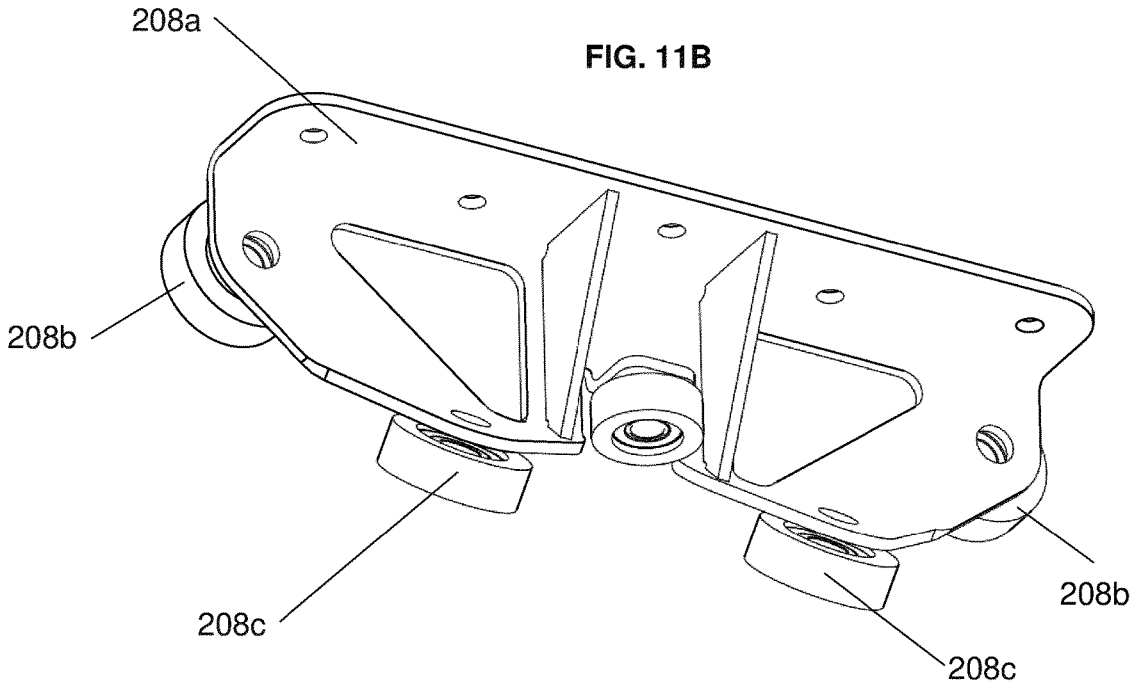
Figure 12A:
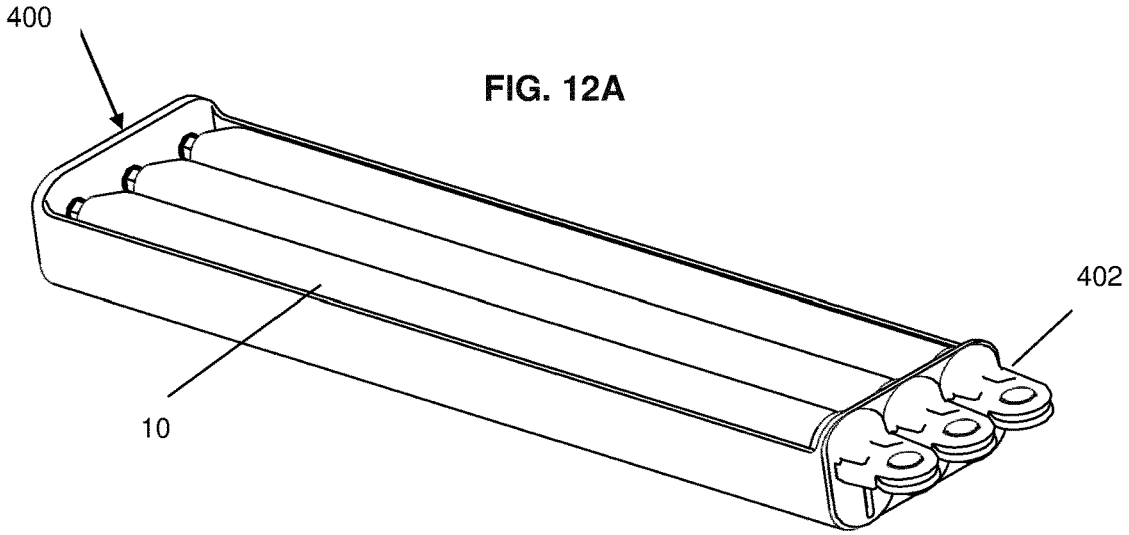
FIGS. 12A to 12F illustrate spring retention housings and retention springs for attachment to the platform and carriage sub-assembly of FIG. 10A.
Figure 12B:
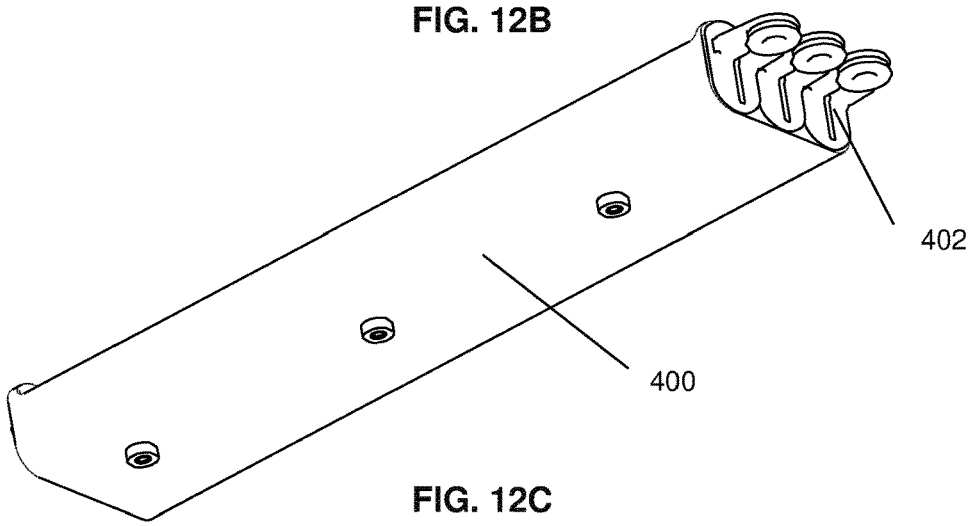
Figure 12C:
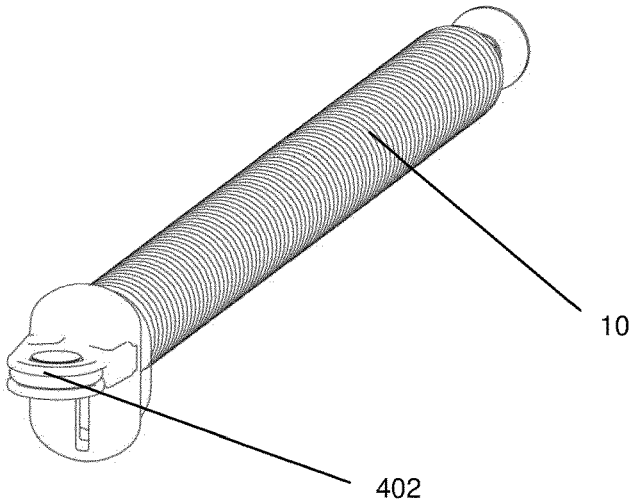
Figure 12D:
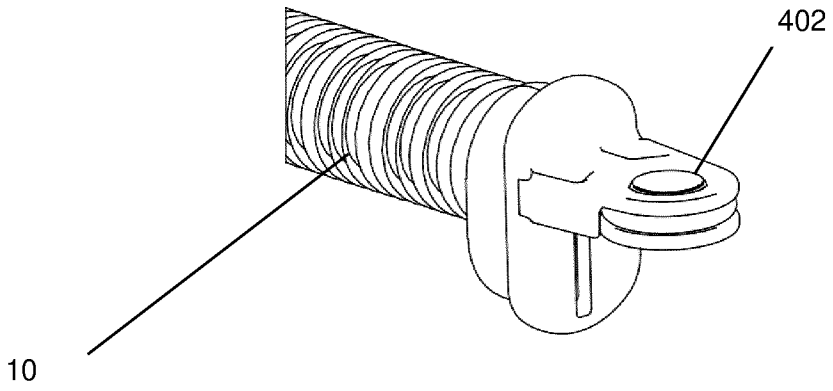
Figure 12E:
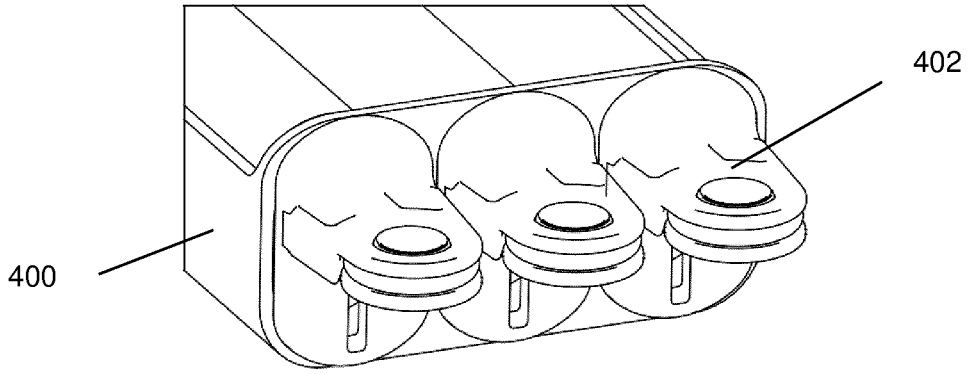
Figure 12F:
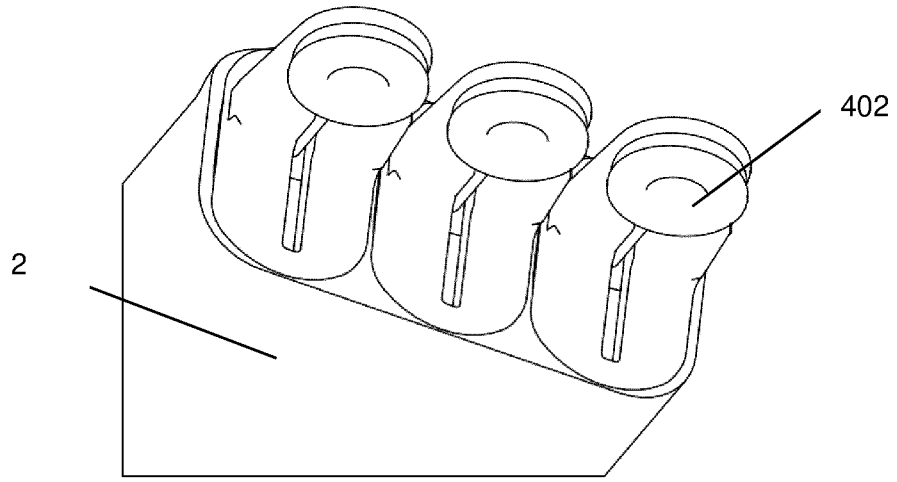

The cords 19 extend from bobbins in recoil units 500 attached to the underside of the platform 9 (see in particular FIGS. 10A and 10C). In this embodiment, the cords then pass through jaws 502 linked to an actuation mechanism 504 and lever 506 which enable the jaws to be opened as desired to allow the cords to be independently adjusted to a desired length or fully, or partially, retracted. Lever 506 could be duplicated on the other side.

Figure 13:
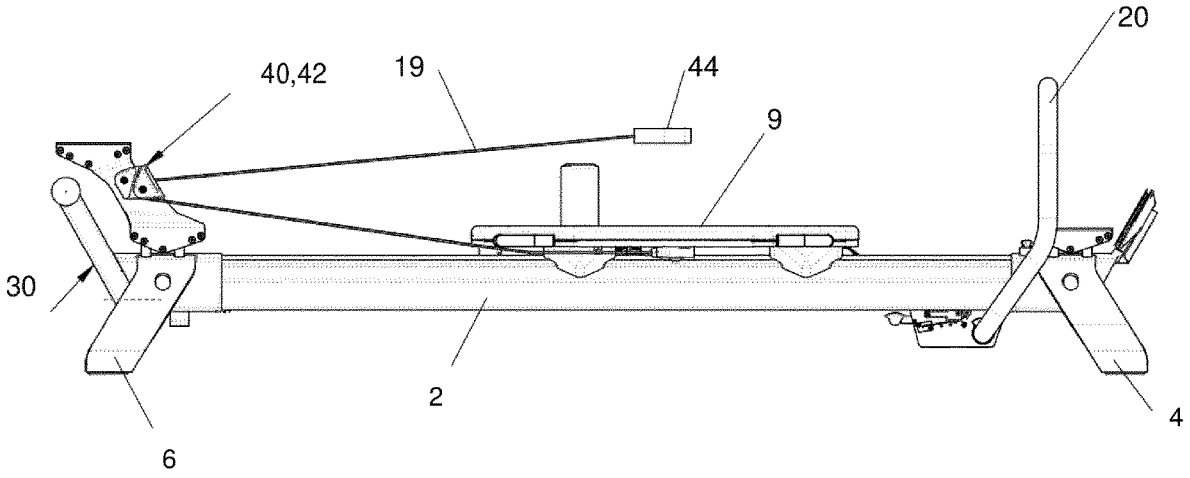
FIG. 13 is a side view of the pilates reformer machine of yet another embodiment of the present invention, illustrating an integral leg exerciser according to an aspect of the invention shown retracted.
Figure 14A:
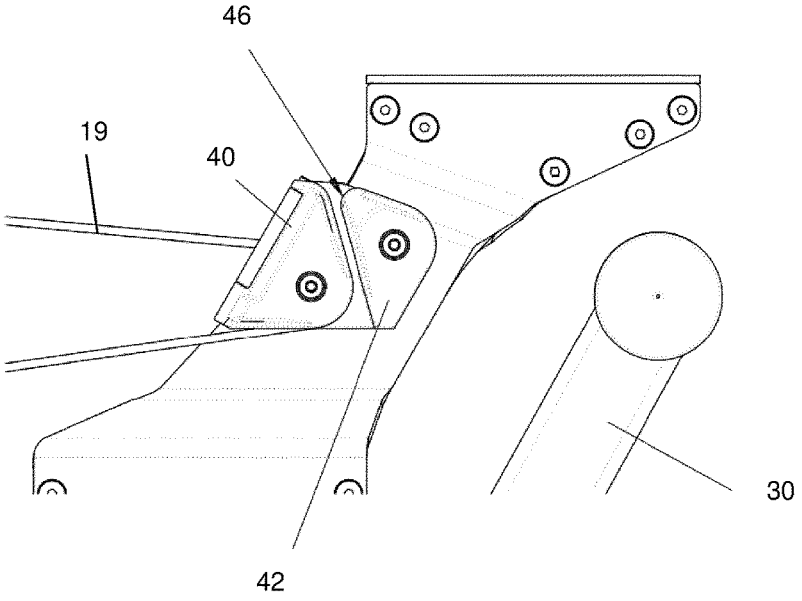
FIGS. 14A to 14F illustrate operation of the leg exerciser shown in FIG. 13 by means of a pulley mechanism.
Figure 14B:
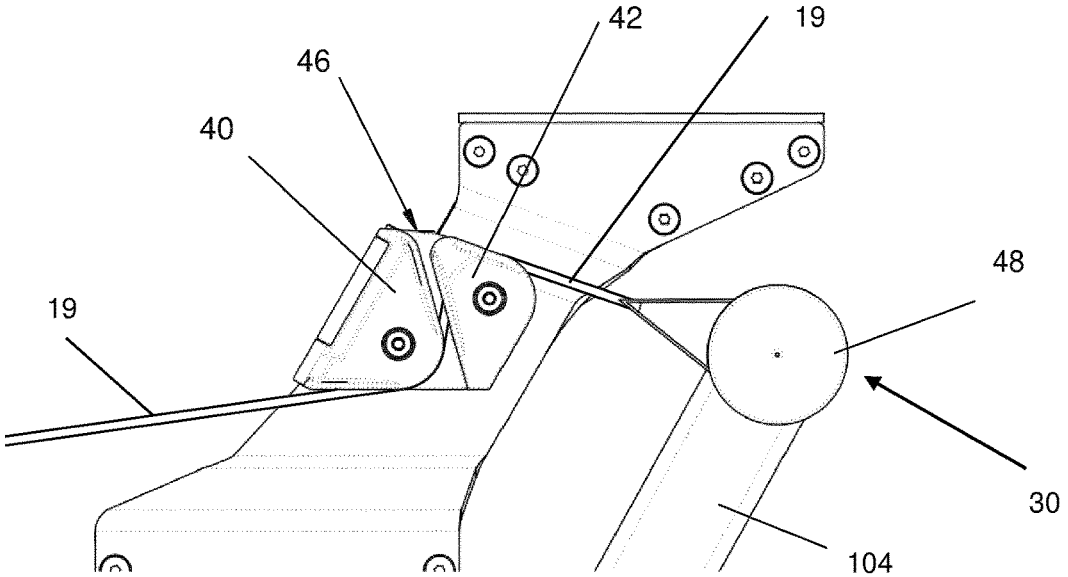
Figure 14C:
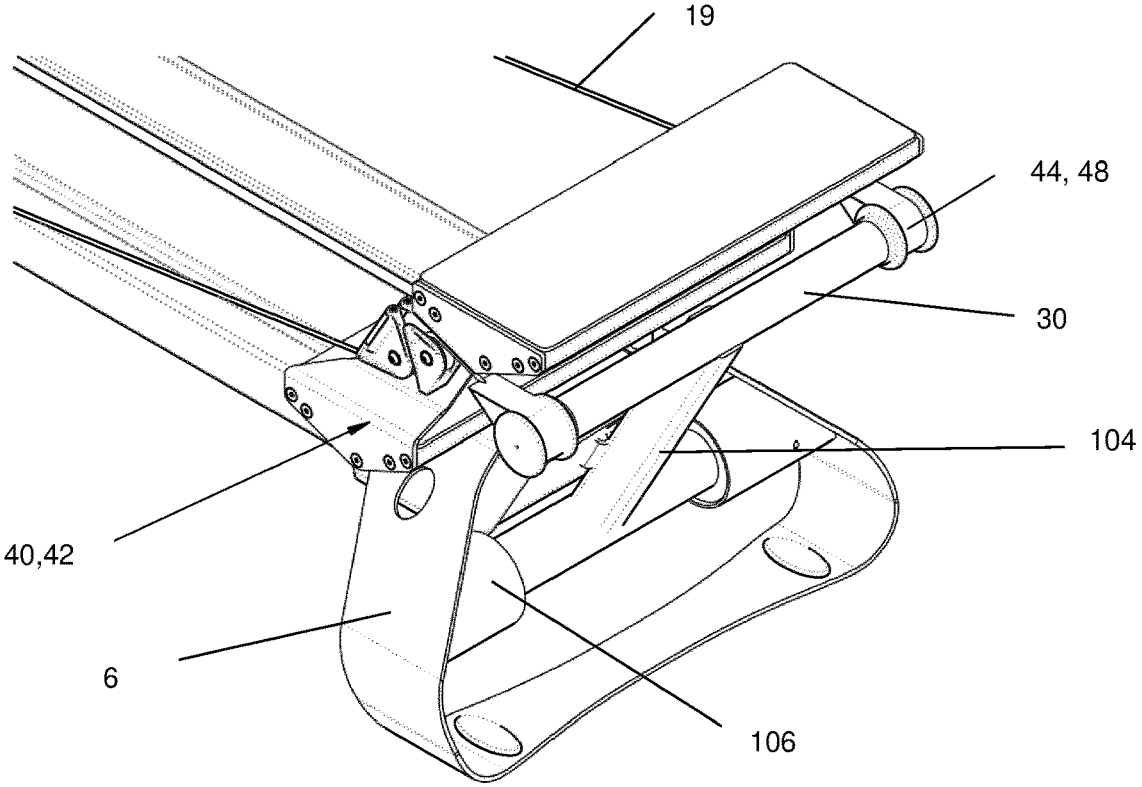
Figure 14D:
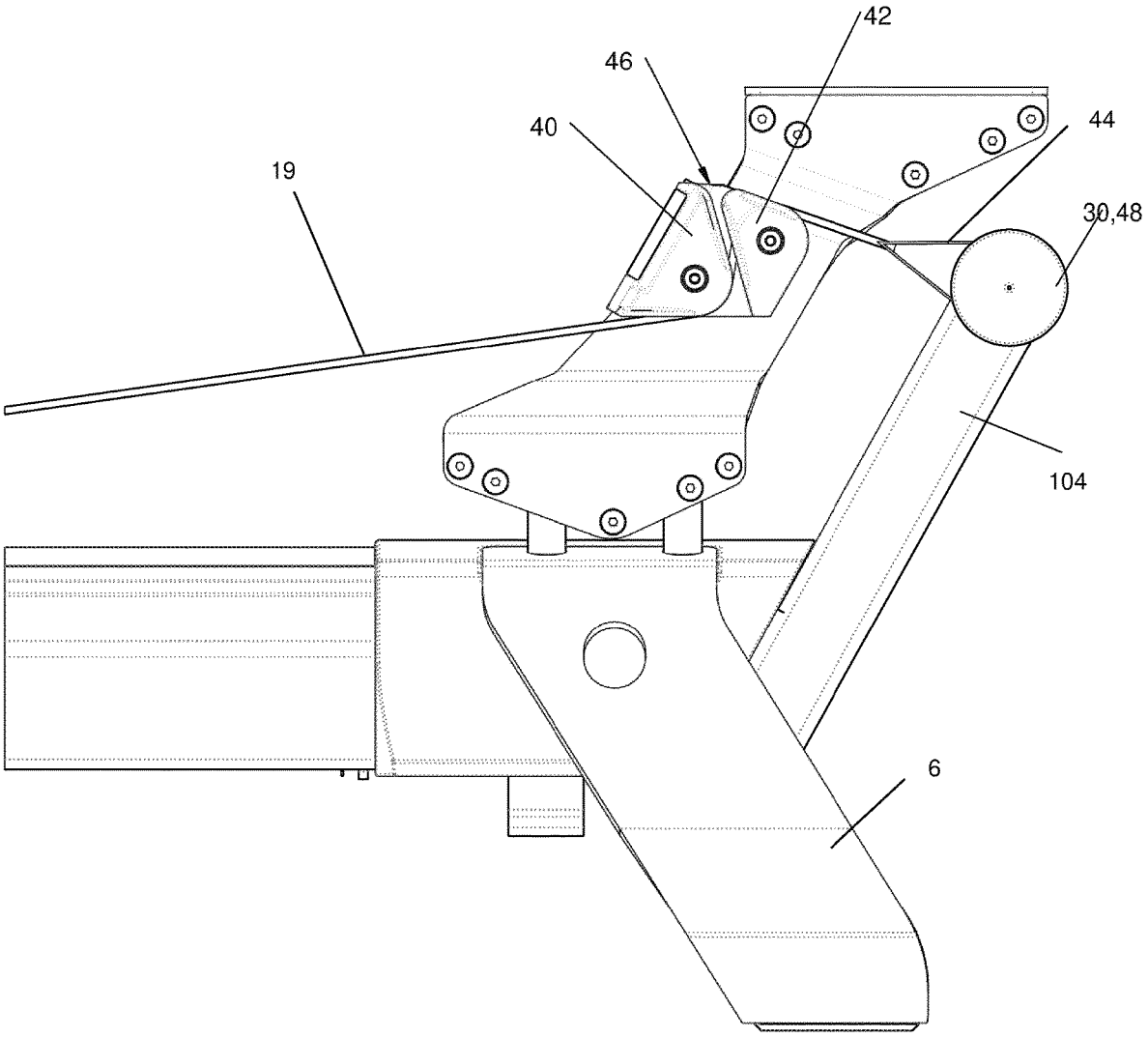
Figure 14E:
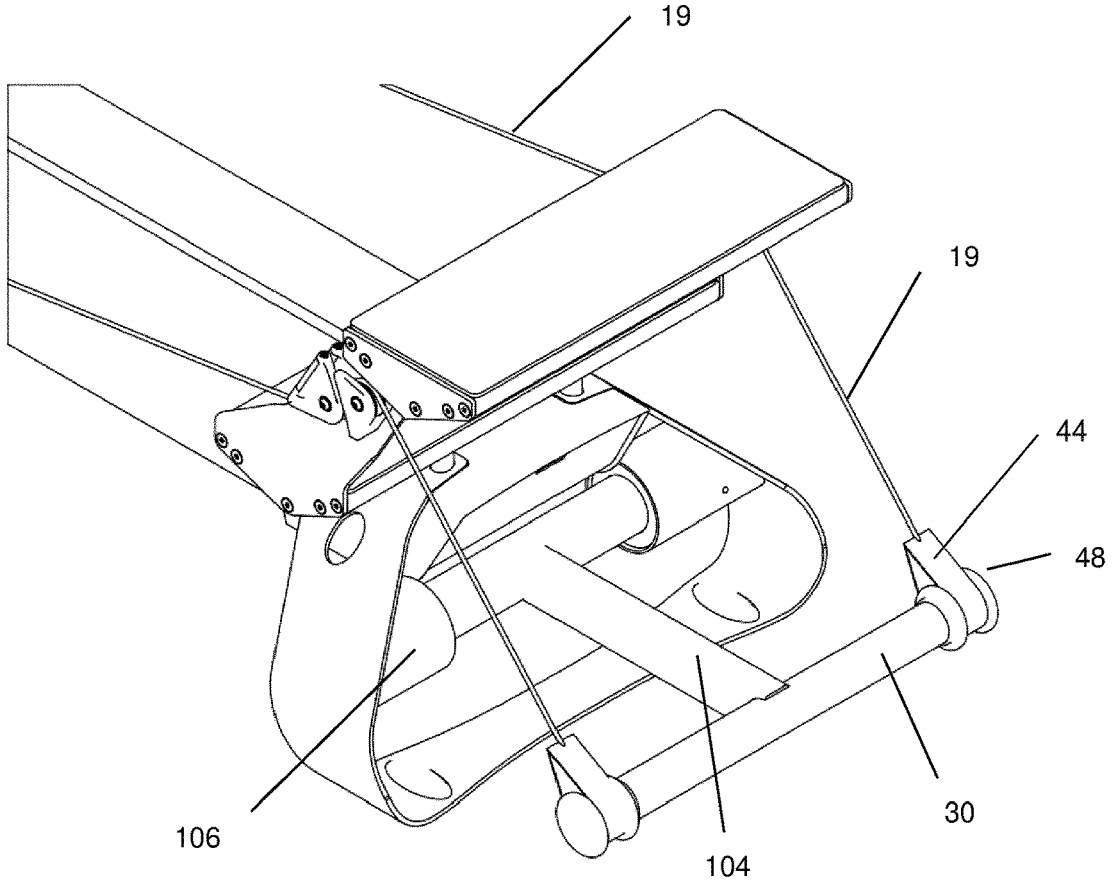
Figure 14F:
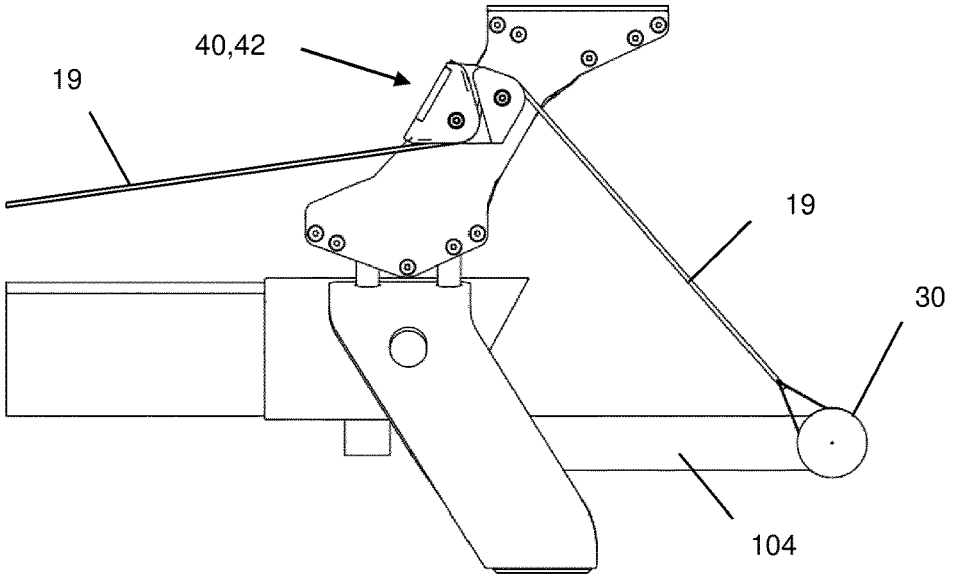

FIGS. 13 to 14F illustrate a leg exerciser 30 according to an aspect of the invention in further detail. FIG. 13 is a side view of the pilates reformer machine illustrating the conventional position for the exercise cords 19 extending from the platform 9 around a pulley mechanism 40 provided on each side of the machine and back to the platform, enabling the user to hold onto the cords using the handles 44 and pull the platform along the central spine in the sitting, lying or standing position on the platform. FIG. 14A shows an expanded view of the pulley mechanism in this position. A slot 46 between the pulley 40 and a second pulley mechanism 42 allows insertion and removal of the cord. Additional rollers may guide the cord when it is in the position shown in FIG. 13.

If the user wishes to operate the leg exerciser, the cord 19 is looped over a second pulley 42 and the respective handle 44 attached to a bobbin 48 provided on an end of the leg exerciser (see FIGS. 14B to 14F). The slot 46 between the pulleys is open at the top so that the cord can be easily repositioned to attach to the leg exerciser. The cords may then be used to pull the foot bar upwardly. The rotating arm 104 of the leg exerciser is also sprung loaded to provide further load and keep the leg exerciser in the up (stowed) position when not in use. Once the user has carried out the required number of lifts using the leg exerciser, the handles can be disconnected from the end of the bars and the cord removed from around the second pulley back to the conventional position.

The pulley system illustrated is shown with the pulley 40, 42 and slot 46 being accessible to the user, thereby enabling the user to manually move the cord between the slot and each pulley. However, the system may be provided as an integral unit or with a cap/cover over the two pulleys to enhance the appearance of the machine and/or prevent users getting things caught in the slot. The size of the handle 44 may also be adjustable around the bobbin provided on the exerciser to enable it to grip the bobbin. Alternatively, the handle may be provided in two parts, for example having first handle of a larger diameter and a second handle of a smaller diameter, preferably provided within the first handle. These handles may be colour coded. For example, the small handle for placement over the bobbin 48 may be provided in the same colour as the bobbin to clarify to the user where the handle should be placed.

Figure 15A:
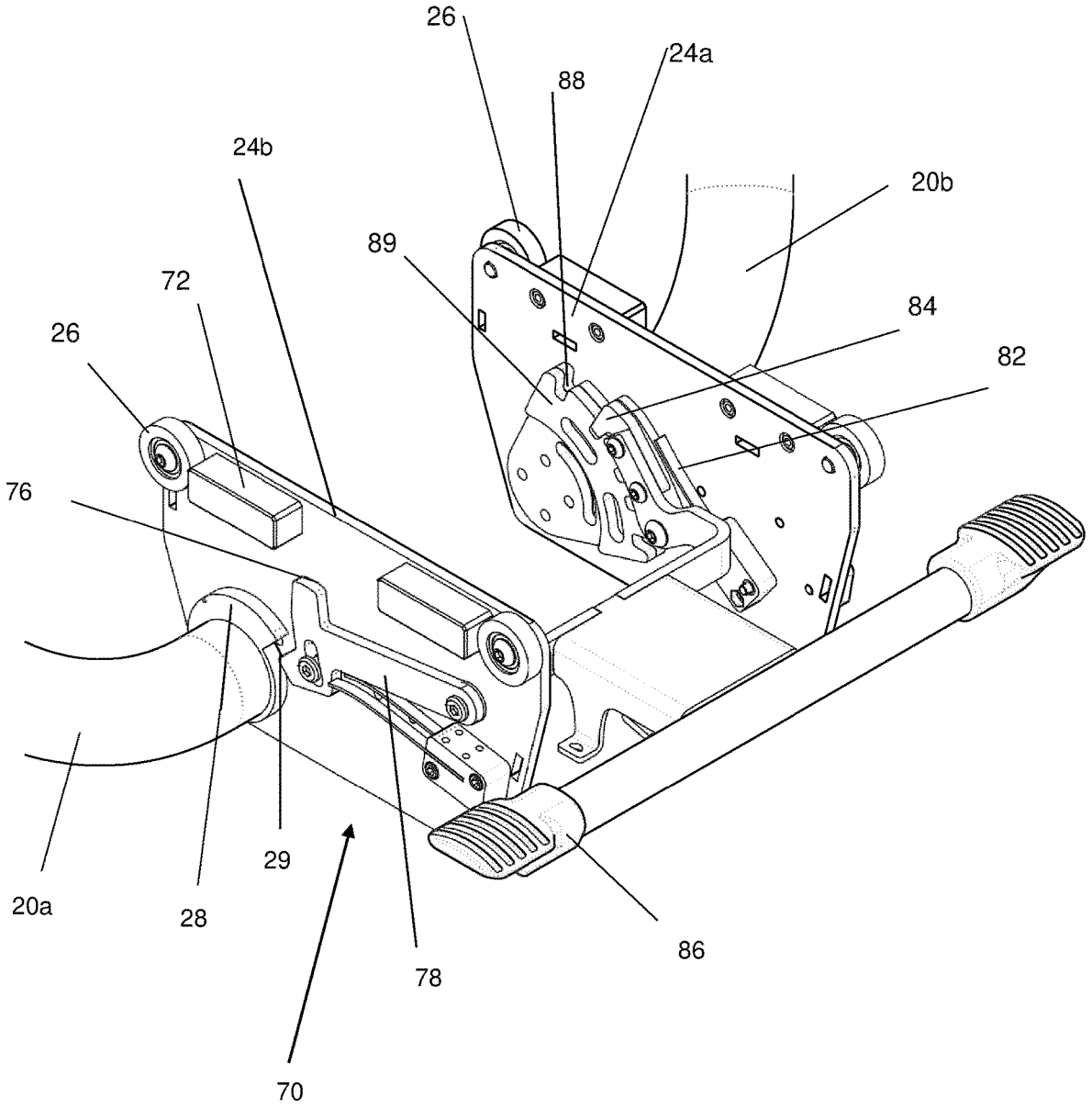
FIGS. 15A and 15B are perspective views of two embodiments of a foot bar location mechanism according to another aspect of the invention.
Figure 15B:
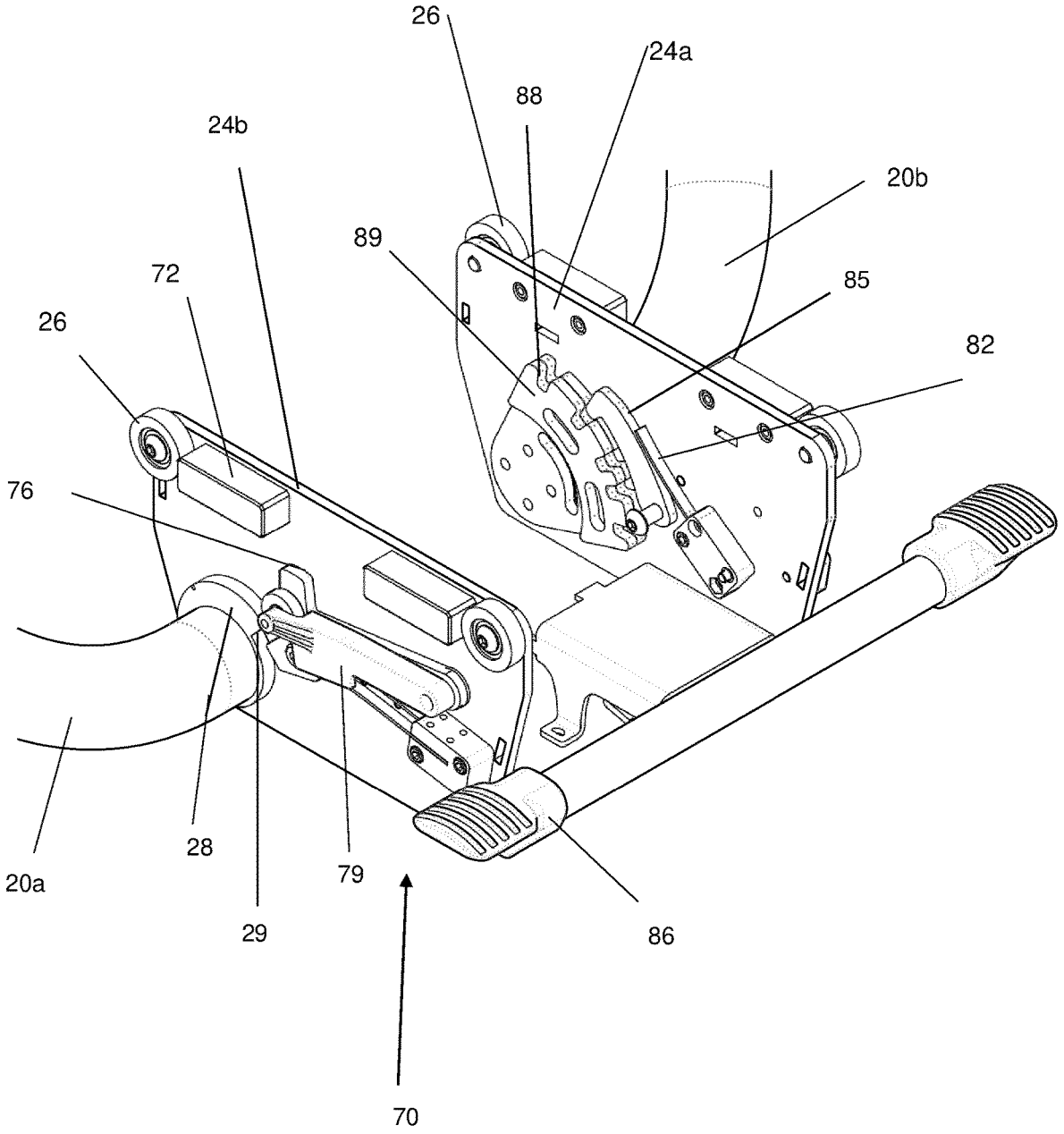
Figure 16A:
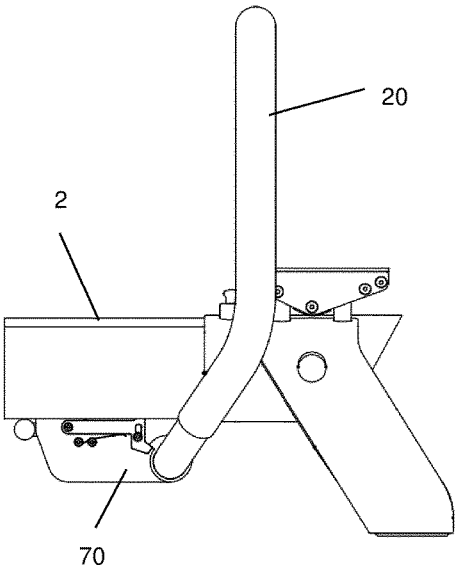
FIGS. 16A to 16D illustrate various selectable positions of the foot bar provided by a mechanism as shown in FIGS. 15A and 15B.
Figure 16B:
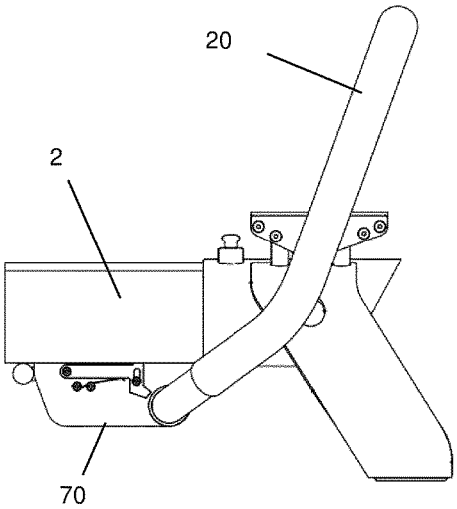
Figure 16C:
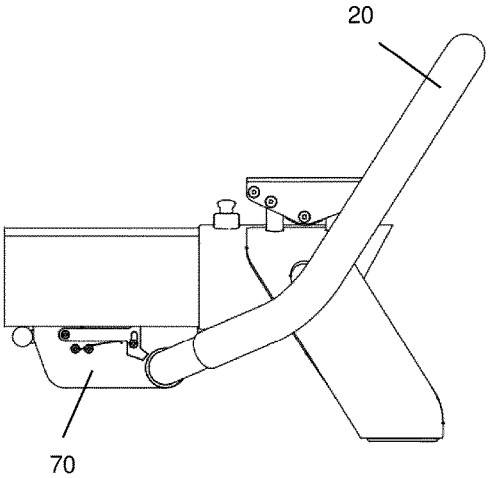
Figure 16D:
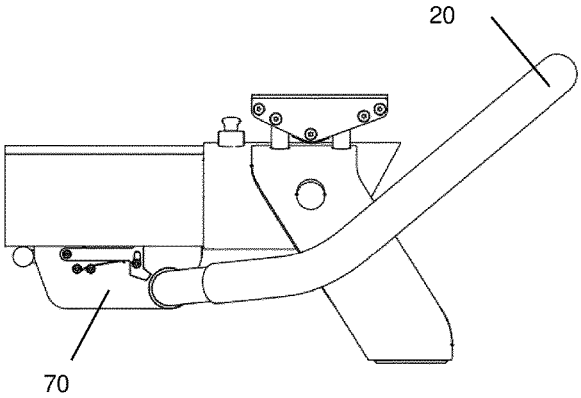

FIGS. 15A and 15B illustrate two embodiments of a foot bar location mechanism 70 according to an aspect of the present invention, the mechanism comprising a bracket 24 consisting of two substantially parallel plates 24*a*, 24*b* linked via a foot pedal 86, the bracket having wheels 26 attached to the outer upper corners of each plate, the bracket enabling attachment of the foot bar 20 to the central spine (not shown for simplicity in FIGS. 15A and 15B but illustrated in FIGS. 6B and 8) which allows the foot bar to travel along the spine but enables it to be locked in a desired longitudinal position and to be locked at a desired angle with respect to the horizontal spine (as shown in FIGS. 16A to 16D). It is to be appreciated that this mechanism could be provided in any of the embodiments of the pilates reformer machine described herein and it is not limited to one embodiment. In this respect, the size of the plates and width of the bracket and foot pedal could be adjusted to enable the mechanism to fit any specific machine.

The foot bar location mechanism 70 has a number of internal components provided on inner opposing sides of the bracket plates 24*a*, 24*b* that interact to allow rotation of the foot bar between a number of pre-set angles, and a number of external components provided on opposing external sides of the bracket plates which allow longitudinal movement of the foot bar. Generally, the internal and external components on one side plate are a mirror-image of the corresponding components on the other side plate. The travel bearings or wheels 26 are received within tracks provided in the extruded spine (for example, 118, 214 of FIGS. 5A and 6A) with guide blocks 72 to provide location and free running within the extrusion rails. Each end 20*a* and 20*b* of the foot bar 20 is attached to opposing external side plates by an annular socket 28 that has a notch 29 which may engage with a part of a longitudinal travel lever 78 provided on the external side of each plate of the bracket, the level having a travel latch 76 extending upwardly therefrom. The foot bar may be locked in a longitudinal position by the travel latch 76 mating with holes or recesses provided in the spine (see, for example, 120 in FIG. 7B). A second latch 79 may optionally be provided (see FIG. 15B) to communicate less well with the holes or recesses, being sprung loaded by means of a spring leaf to hold the foot bar less firmly between the incremental longitudinal positions.

The foot bar 20 is lockable at a particular angle by an angular position latch 84. The angle of the foot bar is selected by means of a foot pedal 86 linked to the angular position latch 84 provided on opposing inner sides of the bracket 24. Movement of the foot pedal 86 enables the latch 84 to move between angular detents 88 provided on a latch member 89 on both inner sides of the bracket and attached to the ends of the foot bar 20*a* and 20*b* such that they rotate with it when free (when the latch 84 is disengaged). A second latch 85 may optionally be provided (see FIG. 15B) to communicate less well with the detents 88 of the latch member, being sprung loaded by means of a spring leaf 82, to hold the foot bar less firmly in the incremental angular positions. This stops the foot bar falling when the angular position latch is disengaged and gives the user some feel as to where the positions are. When the foot bar 20 is rotated beyond vertical in the direction opposite to the latching angles, the longitudinal travel lever 78 is rotated such that its latch 76 disengages from the holes or recesses provided in the spine (see, for example, 120 in FIG. 7B). This rotation is affected by manually rotating the foot bar 20. Note that the foot bar can only be rotated when the angular position latch 84 is disengaged by pressing the food pedal 86.

The ability to rotate the foot bar using a foot pedal that acts on both sides of the bar provides more convenient means to alter the angle of the foot bar with respect to the longitudinal axis of the machine. Preferably, the foot pedal is sprung mounted.

Additionally, the pilates reformer machine may include a mechanism that prevents pressing of the buttons when the carriage is "out", i.e. prevents pressing of the button/plunger mechanism when the spring or band 10 is disengaged and the carriage has been moved away from the end of the machine during exercise. FIGS. 17A and 17B illustrate such a mechanism according to another aspect of the invention that may be employed in any pilates reformer machine. Again, identical features already discussed in relation to earlier embodiments are given the same reference numerals for the sake of simplicity. A sprung loaded locking pin 302 is provided in a transverse channel in the end of the frame or spine at or towards the base of each vertical channel that receives a plunger 14. Upward movement of the button and plunger to disengage the retention spring (see FIG. 17B) creates a space beneath the vertical plunger into which the locking pin 302 is able to slide, thereby preventing downward movement of the button while the lock pin is in this position. The end of each retention spring or band 10 is provided with an opposing transverse plunger 304 that is able to push the lock pin back out of the space beneath the button/plunger 12, 14 when the carriage returns to the end of the spine, thereby allowing the button and plunger to be pushed downwardly to re-engage with the retention spring. In the preferred embodiment shown, the end of each spring is provided with an eyelet forming the transverse plunger 304 whereby the leading edge of the eyelet is able to push the locking pin out of the channel enabling the vertical plunger to drop down through the hole 304*a* of the eyelet. A microswitch 306 is also provided at the base of each channel to enable monitoring of which retention springs are engaged and which are disengaged.

Additionally, it is preferable to include means to encourage the button/plunger 12, 14 to be in either the down position, with the retention spring/band engaged, or the up position, with the retention spring/band disengaged from the frame. To this end, a detent 605 is provided protruding from one or both sides of the vertical channel that houses the vertical plunger. An intermediate region of the plunger is provided with a curved profile 604 between upper and lower regions that have straight sides, the length of the curved profile corresponding to the range of upward/downward movement of the vertical plunger. In this manner, movement of the button upwardly will encourage the plunger to move to a position wherein the detent is at the lowermost part of the curved profile (see FIG. 17B) whereas downward movement of the button will encourage the plunger to move to a position wherein the detent 605 is located in the uppermost part of the curved profile (see FIG. 17A), thus the detent effectively operates to bias the button/plunger in an up or down position.

The pilates reformer machine described herein in its preferred embodiment has a single extruded spine with a carriage and foot bar which wrap around and under the spine to be received within recesses within the spine, the carriage and foot bar having travel wheels or bearings that run along tracks formed in the extruded spine with retention springs being received within a recess between the extruded spine and the platform. The machine is also provided with an auxiliary leg exercise station with means for using the cord from the main springs for loading. Furthermore, the positioning of the foot bar may be altered by means of a single foot bar location mechanism comprising a bracket provided with a foot pedal, with the bracket being received within recesses provided within the spine. The button and plunger arrangement for selective engagement of the springs provides for safer operation of the machine and provides potential for electrical actuation and control from a central interface. Positional sensing of the carriage along the platform and the resistance on the springs, together with speed of travel will enable an interface to be provided detailing performance, such as work rate and energy consumption.

The invention claimed is:

1. An exercise machine comprising a frame having a longitudinal central spine extending between a first support member and a second support member, a carriage supporting a platform moveable along the spine, at least one retention spring or band housed within the spine and attached to the carriage, the at least one retention spring or band being selectively attachable to the frame, the carriage being provided with sides that wrap around sides of the spine and engage with an underneath of the spine, the carriage and/or platform further including a plurality of wheels receivable within tracks formed on or within the central spine, wherein the spine has an upper part and dependent side parts and the sides of the carriage extend around the side parts and engage with an underneath of the spine, the at least one retention spring and the plurality of wheels being located within the spine, the spine comprising an extrusion, the profile of the extrusion being shaped to create multiple recesses required for receipt of parts of the carriage, associated wheels and the retention springs or bands, and wherein the extruded spine has a slightly curved top surface and two opposing outwardly convex sides that terminate in inwardly-facing opposing carriage wheel tracks and the carriage comprises an extruded part for mating with the spine extrusion.

2. An exercise machine comprising a frame having a longitudinal central spine extending between a first support member and a second support member, a carriage supporting a platform moveable along the spine, at least one retention spring or band housed within the spine and attached to the carriage, the at least one retention spring or band being selectively attachable to the frame, the carriage being provided with sides that wrap around sides of the spine and engage with an underneath of the spine, the carriage and/or platform further including a plurality of wheels receivable within tracks formed on or within the central spine, wherein the spine has an upper part and dependent side parts and the sides of the carriage extend around the side parts and engage with an underneath of the spine, the at least one retention spring and the plurality of wheels being located within the spine, the spine comprising an extrusion, the profile of the extrusion being shaped to create multiple recesses required for receipt of parts of the carriage, associated wheels and the retention springs or bands, and wherein the carriage comprises an extruded part for mating with the spine extrusion, the carriage extrusion comprises two support flanges, having outer sides extending downwardly and inwardly therefrom, a base part extending substantially perpendicularly inwardly from each outer side and inner sides extending upwardly from each base part, the inner sides having inner faces provided with at least one carriage wheel, wherein each inner side is extruded to terminate with at least one retention spring or band housing for receiving a retention spring or band, the retention spring or band being selectively secured to an end of the spine by buttons in cooperation with a plunger that extend through vertical openings provided through the extruded spine to the interior of the housing.

3. The exercise machine as claimed in claim 1 wherein the carriage comprises at least one folded bracket attachable to an underside of the platform, the folded bracket providing sides that wrap around sides of the spine and engage with an underneath of the spine, the platform or carriage further comprising a plurality of wheels receivable within tracks formed on or within the central spine.

4. An exercise machine comprising a frame having a longitudinal central spine extending between a first support member and a second support member, a carriage supporting a platform moveable along the spine, at least one retention spring or band housed within the spine and attached to the carriage, the at least one retention spring or band being selectively attachable to the frame, the carriage being provided with sides that wrap around sides of the spine and engage with an underneath of the spine, the carriage and/or platform further including a plurality of wheels receivable within tracks formed on or within the central spine, and a foot bar that extends around both the central spine and carriage and is selectively movable along the length of the spine by means of a plurality of wheels, the spine having recesses forming foot bar wheel tracks for receiving opposing foot bar wheels.

5. An exercise machine comprising a frame having a longitudinal central spine extending between a first support member and a second support member, a carriage supporting a platform moveable along the spine, at least one retention spring or band housed within the spine and attached to the carriage, the at least one retention spring or band being selectively attachable to the frame, the carriage being provided with sides that wrap around sides of the spine and engage with an underneath of the spine, the carriage and/or platform further including a plurality of wheels receivable within tracks formed on or within the central spine, wherein the spine has recesses forming foot bar wheel tracks for receiving opposing foot bar wheels, the foot bar being a substantially n-shaped bar that is dimensioned to fit around the spine and the carriage, each end of the n-shaped bar having an inwardly extending connecting bar for receipt within a socket that rotatably engages with a foot bar location mechanism, the foot bar location mechanism comprising a bracket having a plurality of wheels for receipt within the foot bar wheel tracks of the spine to enable the foot bar to travel along the length of the spine and wherein the foot bar location mechanism has at least one of locking means to maintain the foot bar at a desired location along the length of the spine and locking means to maintain the foot bar at a desired angle selectable between a series of angles with respect to the spine.

6. An exercise machine comprising a frame having a longitudinal central spine extending between a first support member and a second support member, a carriage supporting a platform moveable along the spine, at least one retention spring or band housed within the spine and attached to the carriage, the at least one retention spring or band being selectively attachable to the frame, the carriage being provided with sides that wrap around sides of the spine and engage with an underneath of the spine, the carriage and/or platform further including a plurality of wheels receivable within tracks formed on or within the central spine, and a leg exerciser attached to one end of the frame, the leg exerciser comprising a cross bar pivotally connected to the frame by at least one pivot arm, wherein at least one cord extends between the carriage to an end of the machine and back to the carriage via a pulley mechanism for enabling a user to move the carriage by pulling on the at least one cord, wherein one end of the cord is wound around a bobbin provided in a recoil unit that is attached to the carriage and the other end of the cord terminates in a handle or cuff, the cord passing around a first pulley provided at an end of the machine, the at least one cord being extendable around the cross bar to impart resistance thereto.

7. An exercise machine comprising a frame having a longitudinal central spine extending between a first support member and a second support member, a carriage supporting a platform moveable along the spine, at least one retention spring or band housed within the spine and attached to the carriage, the at least one retention spring or band being selectively attachable to the frame, the carriage being provided with sides that wrap around sides of the spine and engage with an underneath of the spine, the carriage and/or platform further including a plurality of wheels receivable within tracks formed on or within the central spine, wherein the or each retention spring or band is selectably attachable to the frame by a button and plunger mechanism, and wherein a spring loaded locking pin is provided in a channel transverse to a direction of movement of the button and plunger whereby disengagement of the retention spring or band by movement of the button and plunger allows movement of the locking pin into a space beneath the plunger, further comprising an opposing transverse plunger attached to an end of the retention band or spring for sliding the locking pin out of the space beneath the plunger, the transverse plunger comprising an eyelet attached to an end of the retention band or spring, wherein a leading edge of the eyelet moves the locking pin out of the space beneath the plunger.

8. The exercise machine as claimed in claim 7 wherein each retention spring or band is provided within a housing secured to the carriage or platform and the opposing end of the spring or band is provided with an eyelet for selective attachment to the frame by the button and plunger mechanism.

9. An exercise machine comprising a frame having at least one longitudinal rail extending between a first support member and a second support member, a carriage supporting a platform moveable along the at least one rail, at least one retention spring or band attached to the carriage, the at least one retention spring or band being selectively attachable to the frame and at least one cord extendable from the carriage of the frame and terminating in a handle, the machine further comprising a cross bar pivotally connected to an end of the frame by at least one pivot arm and wherein the at least one cord is selectively positionable between a first position and a second position, wherein in the first position the cord extends around a first pulley back towards the carriage such that applying tension on the cord moves the carriage and in the second position the cord extends around a second pulley spaced apart from the first pulley and the handle of the cord receives a part of the cross bar such that applying tension on the cord applies tension to the cross bar.

10. The exercise machine as claimed in claim 9 wherein two pulley systems each comprising a first and second pulley is provided each side of an end of the frame, whereby in a second position a cord can extend around opposing ends of the cross bar.

11. The exercise machine as claimed in claim 9 wherein the cross bar comprises a T-shaped member that is pivotally attached to the frame or wherein the cross bar is attached to two arms that are each pivotally attached to the frame.

12. The exercise machine as claimed in claim 9 wherein each end of the cross bar is provided with a bobbin or reel for receiving the handle of the cord.

13. An exercise machine comprising a frame having at least one longitudinal rail extending between a first support member and a second support member, a carriage supporting a platform moveable along the at least one rail, at least one retention spring or band attached to the carriage, the at least one retention spring or band being selectively attachable to the frame by a button and plunger mechanism and wherein a movable locking pin is provided in a channel transverse to a direction of movement of the button and plunger whereby disengagement of the retention spring or band by movement of the button and plunger allows movement of the locking pin into a space previously occupied by the plunger, wherein an opposing transverse plunger is attached to an end of the carriage for sliding the locking pin out of the space beneath the plunger, wherein the at least one retention spring is provided with an eyelet at an end thereof, a leading edge of the eyelet forming the opposing transverse plunger.

14. An exercise machine comprising a frame having at least one longitudinal rail extending between a first support member and a second support member, a carriage supporting a platform moveable along the at least one rail, at least one retention spring or band attached to the carriage and a foot bar extending around the carriage, platform and at least one rail, wherein the foot bar includes a foot bar location mechanism comprising a bracket having two substantially parallel plates, each plate having wheels or bearings for running along the at least one rail, an outer face of each plate having a longitudinal travel latch for locking the foot bar in a longitudinal position with respect to the at least one rail and an inner face of each plate having an angular position latch for locking the foot bar at a desired angle selectable between a series of angles with respect to the least one rail and wherein at least one of the longitudinal or angular position latch is movable by a foot pedal connected to the bracket.

15. The exercise machine as claimed in claim 14 wherein the longitudinal travel latch mates with holes or recesses provided at spaced apart intervals along at least part of the length of the least one rail, the foot bar being connected to each plate of the bracket by a rotatable socket, each socket having a notch whereby rotation of foot bar moves the notch to effect movement of the longitudinal travel latch.

16. The exercise machine as claimed in claim 14 wherein each angular position latch mates with a series of recesses provided at circumferentially disposed intervals, the recesses being provided on an inner latch member attached to the inner face of each plate and to an end of each foot bar.

17. The exercise machine as claimed in claim 14 wherein the foot pedal is connected to each angular position latch of the plates to simultaneously effect movement of each latch.

* * * * *